US010311840B2

(12) United States Patent
Guyre

(10) Patent No.: US 10,311,840 B2
(45) Date of Patent: Jun. 4, 2019

(54) CURVED PEDAL

(71) Applicant: Matthew Guyre, Bellevue, ID (US)

(72) Inventor: Matthew Guyre, Bellevue, ID (US)

( * ) Notice: Subject to any disclaimer, the term of this patent is extended or adjusted under 35 U.S.C. 154(b) by 19 days.

(21) Appl. No.: 15/530,680

(22) Filed: Nov. 1, 2016

(65) Prior Publication Data

US 2018/0122342 A1 May 3, 2018

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
None
See application file for complete search history.

(56) References Cited

U.S. PATENT DOCUMENTS 846,391 A * 3/1907 Bower ..... G10D 13/006 84/422.2
852,881 A * 5/1907 Kendis ..... G10D 13/006 84/422.2
1,042,919 A * 10/1912 Hughes ..... G10D 13/006 84/422.2
1,092,276 A * 4/1914 Ludwig ..... G10D 13/006 84/421
1,209,804 A * 12/1916 Bessinger ..... G10D 13/006 84/422.2

(Continued)

FOREIGN PATENT DOCUMENTS

CN 3340657 6/2003
CN 2627614 Y 7/2004

(Continued)

OTHER PUBLICATIONS

Applicant brings to the attention of the Examiner the existence of related copending Design U.S. Appl. No. 29/602,088, filed Apr. 28, 2017 by the same inventor/Applicant as in the present case.

(Continued)

*Primary Examiner* — Robert W Horn
(74) *Attorney, Agent, or Firm* — JTT Patent Services, LLC; Gerald T. Peters; Seiko Brown

(57) ABSTRACT

A curved pedal having a pedal reference plane and having a width direction and a length direction may comprise an actuatable region disposed at a top surface of the curved pedal; and at least one curvature profile in the length direction within at least one portion of the actuatable region. Slope at the top surface relative to the pedal reference plane may vary smoothly within the at least one portion of the actuatable region. Radius of curvature of the top surface within the at least one portion of the actuatable region may, for example, be not less than one-half of the length of the actuatable region. The actuatable region may comprise at least one first convexity, at least one first concavity, and/or at least one second convexity. Where present, the at least one first concavity may be disposed centrally in the length direction between the at least one first convexity and the at least one second convexity. The curved pedal may be mounted in a pedal assembly and used to operate a drum or other such percussion instrument, or any of a wide variety of foot-actuated devices.

20 Claims, 19 Drawing Sheets

(56) References Cited

U.S. PATENT DOCUMENTS 1,319,994 A * 10/1919 Dorn ..... G10D 13/006 84/422.1
D55,365 S 6/1920 Champane
D59,788 S 11/1921 Schwartz
2,132,211 A * 10/1938 Hueckstead ..... G10D 13/006 84/422.1
D116,141 S 8/1939 Marciano
2,540,051 A * 1/1951 Ludwig ..... G10D 13/006 84/422.1
2,628,507 A * 2/1953 Juergens ..... B60K 26/02 74/513
2,680,384 A * 6/1954 Horrocks ..... B60K 26/02 74/513
2,893,284 A 7/1959 Washington
D199,951 S * 12/1964 Golden ..... D12/125
3,592,076 A * 7/1971 Baginski ..... B62M 3/08 74/594.5
4,198,894 A * 4/1980 Della-Porta ..... G10D 13/006 84/422.1
4,310,064 A * 1/1982 Kazarian, Jr. ..... B60T 7/04 180/271
4,313,352 A * 2/1982 Okajima ..... B62M 3/12 74/594.4
4,335,628 A * 6/1982 Shimano ..... B62M 3/08 74/560
4,691,613 A * 9/1987 Jacobson ..... G10D 13/006 84/422.1
D299,222 S * 1/1989 Feamster, III ..... 74/594.4
D311,989 S 11/1990 Parker et al.
D320,369 S * 10/1991 Feamster, III ..... 74/594.4
D326,557 S 6/1992 Gardner
5,423,231 A * 6/1995 Helfrich ..... A61C 1/0023 200/86.5
D390,253 S 2/1998 Bacco
5,773,736 A 6/1998 Hsieh
6,002,076 A 12/1999 Karn
D439,270 S 3/2001 Marcinkiewicz
6,201,173 B1 3/2001 Black
6,361,476 B1 * 3/2002 Eschenbach ..... A63B 22/001 482/51
6,417,433 B1 7/2002 Milla
6,541,686 B2 4/2003 O'Donnell
6,571,662 B1 * 6/2003 Mendis ..... B60K 23/02 307/10.1
6,593,518 B2 * 7/2003 Hsieh ..... G10D 13/006 84/422.1
6,647,826 B2 * 11/2003 Okajima ..... B62M 3/08 74/563
6,684,734 B2 2/2004 Gatzen
6,710,237 B2 * 3/2004 Adams ..... G10D 13/006 84/422.1
D510,965 S 10/2005 Clark
7,197,957 B2 4/2007 Gatzen
D561,236 S 2/2008 Muir
D574,210 S 8/2008 Packard
D588,269 S 3/2009 Wall
7,921,748 B2 * 4/2011 Kim ..... G05G 1/38 74/513
8,026,434 B2 * 9/2011 Luo ..... G10D 13/006 84/422.1
8,455,746 B2 6/2013 Johnston
8,642,868 B1 2/2014 Johnston
8,674,203 B2 3/2014 Simon
8,686,265 B2 4/2014 Johnston
8,927,844 B2 * 1/2015 Kitching ..... G10D 13/006 84/422.1
8,993,865 B2 * 3/2015 Liao ..... G10D 13/006 84/422.1
D729,482 S 5/2015 Lentine
9,075,427 B2 * 7/2015 Muraji ..... B60K 26/021
9,785,183 B2 * 10/2017 Kaijala ..... G05G 1/38
9,840,243 B2 * 12/2017 Saito ..... B60T 11/18
9,981,638 B2 * 5/2018 Kawazu ..... B60T 7/04
D836,710 S * 12/2018 Guyre ..... D17/22
2002/0152872 A1 10/2002 O'Donnell
2003/0154846 A1 8/2003 Adams
2003/0213329 A1 11/2003 Gatzen
2004/0025667 A1 2/2004 Hampton, Jr.
2004/0144198 A1 7/2004 Gatzen
2005/0082786 A1 * 4/2005 Clark ..... B62M 3/08 280/294
2007/0137419 A1 6/2007 Chen
2011/0271818 A1 11/2011 Simon
2012/0144976 A1 6/2012 Johnston
2012/0198984 A1 8/2012 Johnston
2014/0090543 A1 4/2014 Kitching
2014/0109399 A1 * 4/2014 Merlin ..... B60T 7/065 29/700
2014/0116192 A1 * 5/2014 Hemmege Venkatappa ..... G05G 1/44 74/512
2018/0122342 A1 * 5/2018 Guyre ..... G10D 13/006

FOREIGN PATENT DOCUMENTS

CN 100367346 C 2/2008
CN 205428469 U 8/2016
CN 201630460652 8/2016
DE 3819379 A1 12/1989
EP 1112565 A1 7/2001
GB 2234045 A 8/2018
JP 2005173274 A 6/2005
JP 2010243799 A 10/2010
WO 9704440 A1 2/1997
WO 2002086858 A1 10/2002
WO 2018/085341 A1 5/2018

OTHER PUBLICATIONS

Applicant brings to the attention of the Examiner the existence of related copending PCT International Application No. PCT/US17/59463, which was filed on Nov. 1, 2017 by the same inventor/Applicant as in the present case.

Web article entitled "Drum Workshop: MDD Pedals" by John Nyman, published Apr. 24, 2015, downloaded by the undersigned representative for Applicant on Oct. 10, 2016 from http://www.drummagazine.com/gear/post/drum-workshop-mdd-pedals/.

Applicant brings to the attention of the Examiner the existence of related copending U.S. Appl. No. 29/643,358, filed Apr. 6, 2018 by the same inventor/Applicant as in the present case.

Reverb, All About that Bass Drum Pedal, posted on Mar. 4, 2015, [online], [site visited on Jan. 23, 2018]. Available from Internet, <URL: https://reverb.comlnews/all-about-that-bass-drum-pedal> (Year: 2015).

* cited by examiner

CURVED PEDAL

FIELD OF THE INVENTION

The present invention relates to a curved pedal and to a device employing a curved pedal; in particular, the present invention relates to a curved pedal for a drum or other foot-operated device where dexterity, responsiveness, and/or comfort when operating for an extended period of time are desired.

BACKGROUND

Many devices employ pedals for foot-actuated operation. Among the many devices capable of foot-actuated operation by way of pedal(s) are automobiles, helicopters, airplanes, backhoes and other such vehicles and heavy equipment, looms, sewing machines, treadles, knitting machines, mills, lathes, pumps, and other such industrial apparatuses, to name just a few examples.

Another category of device which may employ pedal(s) for foot-actuated operation is musical instruments such as organs, pianos, and other keyboard instruments, as well as drums, cymbals, and other such percussion instruments.

Drum pedals have been used for playing drums for more than a century. Many improvements on the drum pedal have been made, allowing better operability and facilitating various performance styles.

One factor still in need of improvement with pedals currently on the market is comfort. Repeated multiple beats, e.g., doublets, triplets, etc., provide an attractive performance but can be difficult and tiring for many players. Many players find that their foot becomes fatigued after performing for an extended period of time, especially when generating repeated multiple beats in rapid succession.

Another factor still in need of improvement with pedals currently on the market is ability to accommodate various techniques.

To generate a doublet, i.e., two repeated beats, a player might simply repeat the same foot movement twice in rapid succession, or for improved comfort and greater degrees of freedom during playing a player might, for example, employ a sliding technique or a heel-toe technique.

In a sliding technique for producing a doublet, a player might first depress one location of the drum pedal with his or her toe to generate a first stroke, slide the foot along the pedal toward the toe or the heel end of the pedal, and then depress a second location of the pedal to generate a second stroke. However, with a conventional flat pedal, many players find foot positioning difficult and find the sliding motion difficult to control or uncomfortable.

In a heel-toe technique for producing a doublet, a player might first depress the pedal with his or her heel to generate a first stroke, and then tilt the toe down to depress the pedal with his or her toe to generate a second stroke. This technique can cause fatigue of the ankle when playing for an extended period.

Similar techniques may also be employed for producing a triplet, i.e., three repeated beats, which is generally even more difficult than a doublet.

Conventional pedals are typically flat, or where such conventional deviate from planar, they may have spiky protrusions, and may employ joggled or stepped surfaces.

With a flat drum pedal, techniques such as the sliding technique and the heel-toe technique are tiring and are difficult to master. A flat pedal is generally devoid of features that might assist the player in locating the foot during playing. Unless a player can quickly and reliably locate his or her foot by the "feel" of the pedal, it will be difficult to develop the dexterity required for advanced sliding and heel-toe techniques.

Furthermore, a flat pedal is a poor match for the shape of the foot, and a flat pedal requires considerably more movement of the foot and/or ankle than would be necessary if the pedal were a better match for the shape of the foot.

Moreover, when using the heel-toe technique with a flat pedal, the heel and/or toe tend to strike the pedal surface at a glancing angle. A pedal shape that would permit the foot—and in particular the heel of the foot and/or the ball of the foot (note that the term "toe" as used herein may include the ball of the foot)—to strike the pedal at an angle more nearly perpendicular to the pedal surface would improve the leverage or efficiency with which force is transferred from the player's foot to the drum pedal, permitting stronger and/or less tiring performance.

Furthermore, a pedal surface that is interrupted by spiky protrusions or sharply stepped surfaces is not conducive to techniques that utilize sliding motion of the foot across the pedal surface. Moreover, a pedal having a smoothly varying contour would be especially desirable for a player who employs bare feet or who wears socks but no shoes or who wears thin shoes or other such foot coverings for improved comfort and sensitivity in locating the foot on a pedal.

In addition, whereas conventional pedals tend to be only slightly longer than the foot of the player, a pedal that is substantially longer than the foot of the player would not only increase leverage about the fulcrum of the heel hinge, permitting more powerful and/or less tiring playing, but would also facilitate more sustained sliding along the length direction of the pedal. A pedal substantially longer than the foot of the player may also accommodate multiple striking locations beyond the basic heel-toe striking positions employed conventionally.

There is therefore a need for an improved pedal that addresses at least one of the foregoing issues.

SUMMARY OF INVENTION

One aspect of the present invention is a curved pedal. Another aspect of the present invention is a pedal assembly or other device employing such a curved pedal. One embodiment of the present invention is a curved pedal for a drum or other foot-operated device where dexterity, responsiveness, and/or comfort when operating for an extended period of time are desired.

In accordance with one embodiment, a curved pedal may have a pedal reference plane, width direction, and length direction.

The curved pedal may comprise an actuatable region for actuation by a foot. The actuatable region may be disposed at a top surface of the curved pedal.

The curved pedal may comprise at least one curvature profile in the length direction within at least a portion of actuatable region and/or within the entire actuatable region.

Slope at the top surface of the curved pedal relative to the pedal reference plane may vary smoothly within at least a portion of actuatable region and/or within the entire actuatable region.

Change in slope as a function of position in the length direction, i.e., the second spatial derivative with respect to position in the length direction, within at least a portion of actuatable region and/or within the entire actuatable region might, for example, be not greater than 30° per inch and/or 11.25° per inch±75%.

Radius of curvature of the top surface of the curved pedal within at least a portion of actuatable region and/or within the entire actuatable region may, for example, be not less than one-half of the length of the actuatable region, might be not less than 3", and/or might be 8"±75%.

The at least one curvature profile might be more or less sinusoidal with wavelength 10"±50% and amplitude 0.30"±75%.

The at least one curvature profile might be more or less elliptically arcuate with radius of curvature 8"±75% and have an extremum of height 0.30"±75% as measured from the pedal reference plane.

The at least one curvature profile might be more or less circularly arcuate with radius of curvature 8"±75% and have an extremum of height 0.30"±75% as measured from the pedal reference plane.

The at least one curvature profile might be approximated by a polynomial curve of order not less than three with radius of curvature 8"±75% and have an extremum of height 0.30"±75% as measured from the pedal reference plane.

The actuatable region may comprise at least one first convexity, at least one first concavity, at least one second convexity, and/or at least one flat portion.

Where at least one first convexity, at least one first concavity, and at least one second convexity are present, the at least one first concavity may be disposed centrally in the length direction between the at least one first convexity and the at least one second convexity.

The at least one first convexity and/or the at least one second convexity might be substantially a half-lobe that extends or extend not more than 25% peripherally past an extremum or extrema thereof.

Length of actuatable region in the length direction might be not less than 12".

The curved pedal may comprise a heel end having at least one feature permitting mounting to a heel hinge.

The curved pedal may comprise a toe end having at least one feature permitting mounting to at least one pivoting linkage arm.

The curved pedal may be mounted in a pedal assembly and used to operate a drum or other such percussion instrument, or any of a wide variety of foot-actuated devices.

Other embodiments, systems, methods, and features, and advantages of the present invention will be apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. In the drawings, like reference numerals designate corresponding parts throughout the several views, description that would be repetitive being omitted for convenience.

FIG. 5B showing curved pedal 330 comprising first convexity 340 and first concavity 350; FIG. 5C showing curved pedal 430 comprising first concavity 450 and first convexity 440; FIG. 5D showing curved pedal 530 comprising first convexity 540, first concavity 550, and second convexity 560; FIG. 5E showing curved pedal 630 comprising first convexity 640; FIG. 5F showing curved pedal 730 comprising first convexity 740; FIG. 5G showing curved pedal 830 comprising first convexity 840 and second convexity 860; FIG. 5H showing curved pedal 930 comprising first convexity 940 and first concavity 950; FIG. 5I showing curved pedal 1030 comprising first convexity 1040, first concavity 1050, and second concavity 1070; and FIG. 5J showing curved pedal 1130 comprising first convexity 1140, first concavity 1150, and second convexity 1160.

DETAILED DESCRIPTION

One embodiment of the present invention is a curved pedal.

A curved pedal in accordance with an embodiment of the present invention may be employed in any of a wide variety of devices that employ pedals for foot-actuated operation, such as automobiles, helicopters, airplanes, backhoes and other such vehicles and heavy equipment, looms, sewing machines, treadles, knitting machines, mills, lathes, pumps, and other such industrial apparatuses.

Although embodiments of the present invention are described in terms of an example in which a curved pedal mounted in a pedal assembly operates a beater to strike a vertical bass drum, it should be understood that the present invention is not limited to the example of a pedal assembly for causing actuation of a beater that strikes a vertical bass drum, but may also be applied to a pedal assembly for causing actuation of a beater that strikes a horizontal bass drum, a pedal assembly for causing actuation of high-hat cymbals, and to a pedal assembly for causing actuation of any of a wide variety of devices in which motion from a foot-actuated pedal can be converted into motion for driving and/or controlling the device or any portion thereof through an appropriate linkage or transmission mechanism, of which the pedal assembly described below is merely one example.

Figure 1:
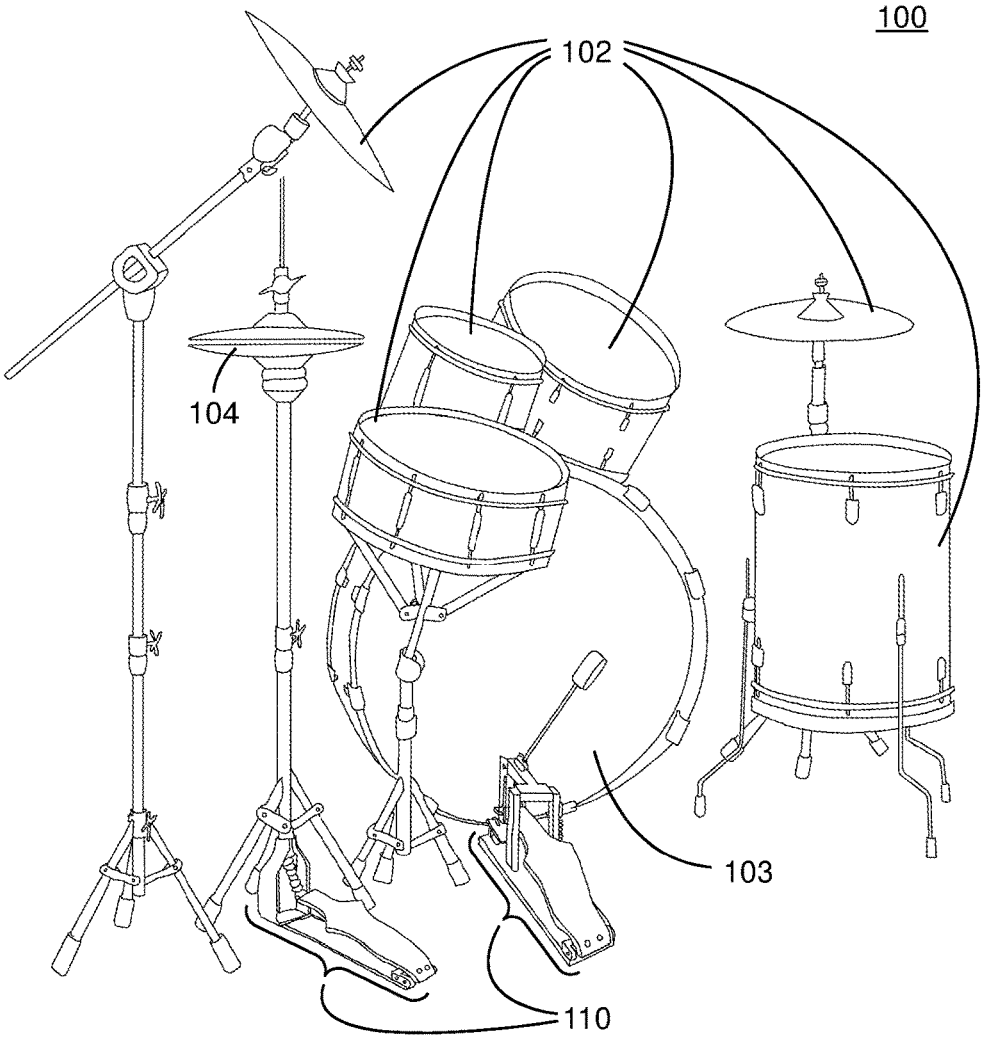
FIG. 1 shows drum set 100, this being an example of a system employing foot-operated device(s) requiring rapid, dexterous, and/or repeated actuation over an extended period of time, and which contains percussion instrument(s) 102, at least one of which is capable of being actuated by foot by way of pedal assembly 110 in accordance with an embodiment of the present invention.

Referring to FIG. 1, this shows drum set 100. Drum set 100 is an example of a system employing foot-operated device(s) requiring rapid, dexterous, and/or repeated actuation over an extended period of time. More specifically, drum set 100 includes a number of percussion instruments 102, two among which, i.e., bass drum 103 and high-hat cymbals 104, are capable of being actuated by foot by way of respective pedal assemblies 110. The description that follows is given in terms of an example in which pedal assembly 110 operates a beater that strikes bass drum 103, but pedal assembly 110 may be applied to actuation of high-hat cymbals 104 or to any of a wide variety of devices that may employ pedals for foot-actuated operation.

Figure 2:
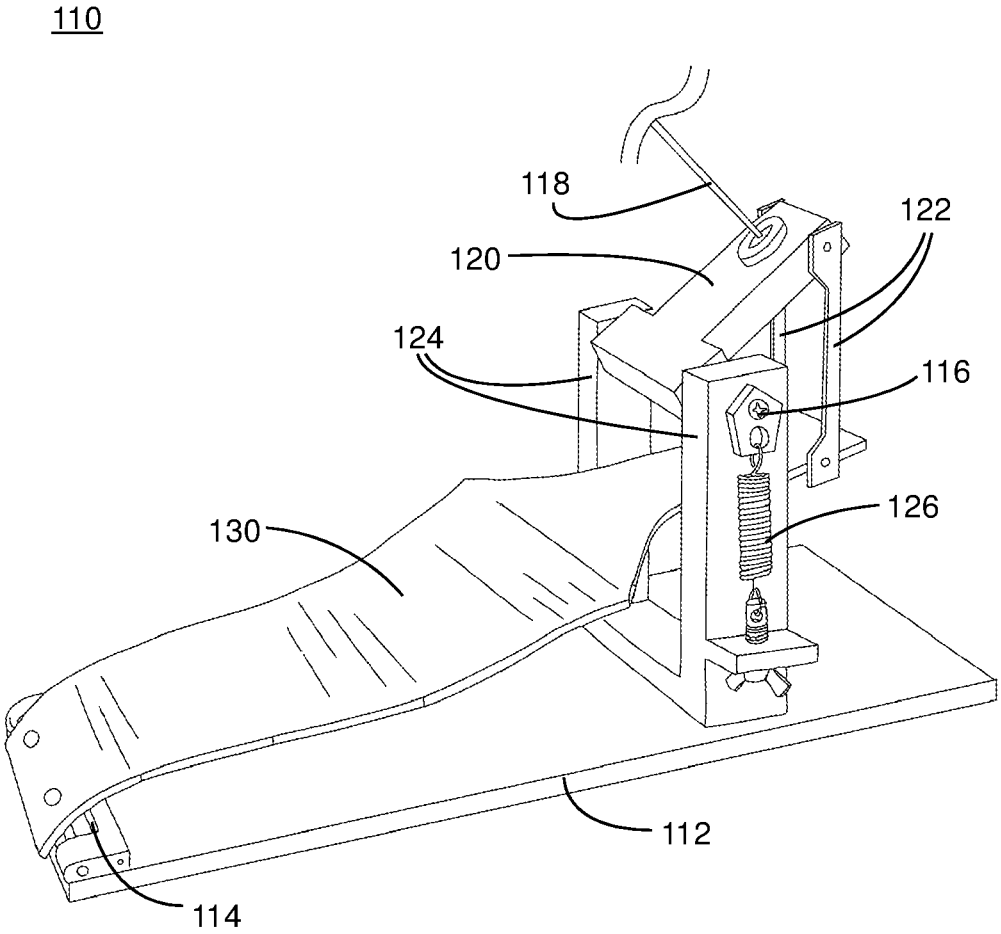
FIG. 2 is a perspective view of a pedal assembly 110 that may be employed at drum set 100 of FIG. 1 in accordance with an embodiment of the present invention.
Figure 3:
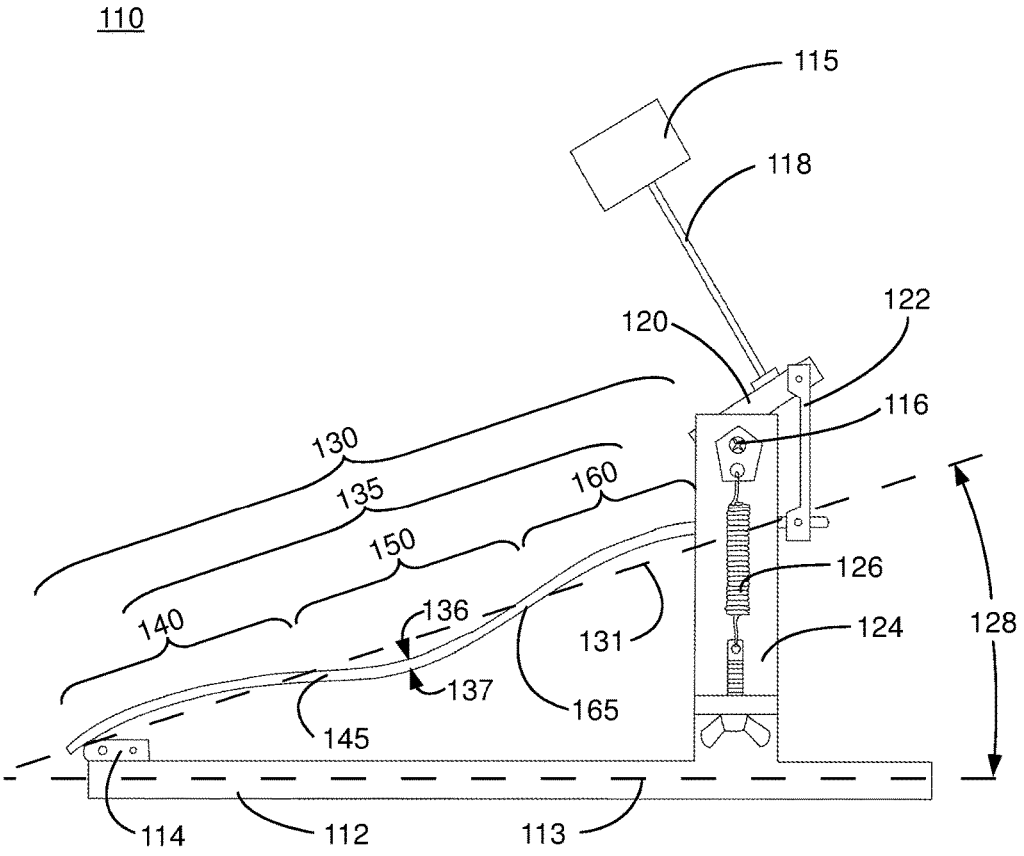
FIG. 3 is a side view of pedal assembly 110 of FIG. 2 and shows curved pedal 130 having actuatable region 135 comprising portion(s) 140, 150, 160 that is or are convex and/or concave relative to pedal reference plane 131 in accordance with an embodiment of the present invention.

Referring now to FIGS. 2 and 3, these respectively show perspective and side views of a pedal assembly 110 in accordance with one embodiment of the present invention.

In the embodiment shown in FIGS. 2 and 3, pedal assembly 110 comprises curved pedal 130, one end of which, hereinafter referred to as the heel end, has hole(s) and/or other features permitting it to be pivotably mounted on heel hinge 114 at a location toward what will be referred to as the heel end of baseboard 112. The other end of curved pedal 130, hereinafter referred to as the toe end, is free to pivot about the shaft of heel hinge 114 as curved pedal 130 goes from its raised or undepressed position at which pedal reference plane 131 is more or less inclined at pedal mount angle 128 to its lowered or fully depressed position at which pedal reference plane 131 is more or less parallel (except to the extent limited by a stopper or the like to prevent damage to the drum surface or other parts) with baseboard plane 113, when curved pedal 130 is depressed by a foot against the restoring force provided by pedal return spring 126.

Having identified one end of curved pedal 130 as the heel end thereof, and having identified the other end of curved pedal 130 as the toe end thereof, these directions, i.e., the heel end or side which is toward the left as seen in FIG. 3, and the toe end or side which is toward the right as seen in FIG. 3, may be employed herein for convenience of description.

Pivoting linkage arms 122 are oriented more or less vertically, the bottom ends of pivoting linkage arms 122 being connected to either side of the toe end of curved pedal 130, toe end of curved pedal 130 having hole(s) and/or other features permitting connection to the bottom ends of pivoting linkage arms 122, and the top ends of pivoting linkage arms 122 being connected to either side of the toe end of a rocker 120 on which beater stem 118 terminating in beater 115 is mounted. As the toe end of curved pedal 130 swings through its arc about the pivot of heel hinge 114, transfer of this rotary motion to rocker 120 via pivoting linkage arms 122 causes rocker 120 to pivot about rocker axle 116 which is supported by bearings held by support posts 124 secured to baseboard 112.

Figure 4:
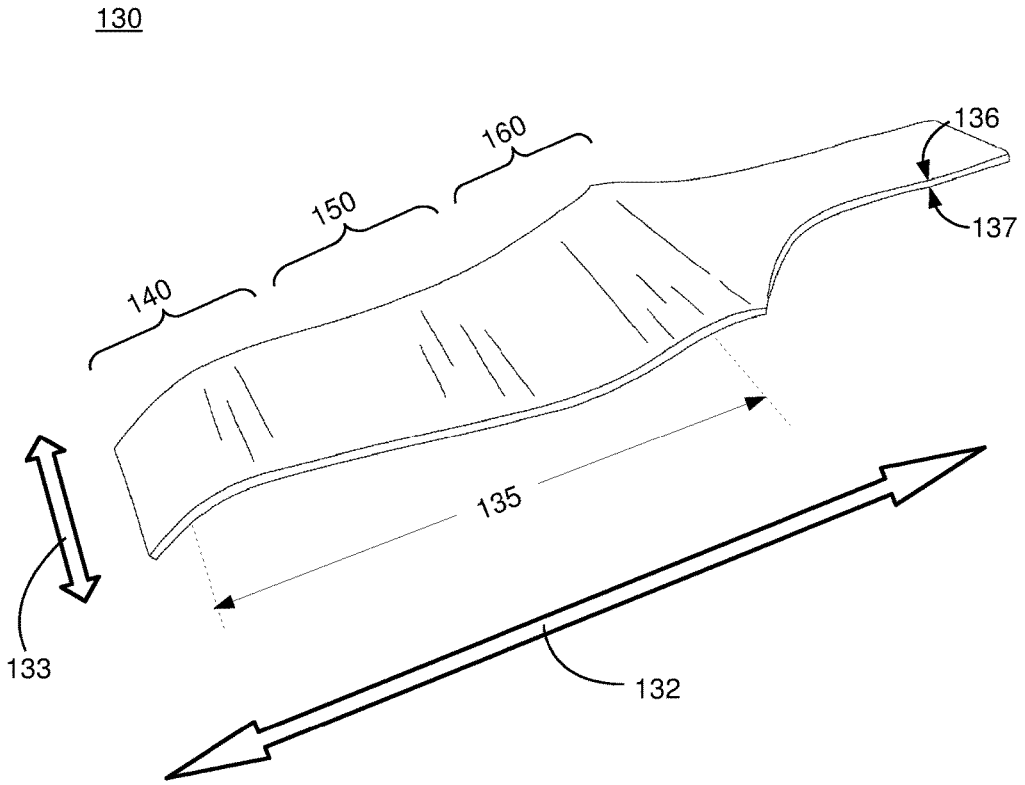
FIG. 4 is a perspective view of curved pedal 130 of FIG. 3 in which first convexity 140, first concavity 150, and second convexity 160 are arranged in length direction 132 of actuatable region 135 in accordance with an embodiment of the present invention.

With continued reference to FIG. 3 and additional reference to FIG. 4, curved pedal 130 will now be described. FIGS. 3 and 4 respectively show side and perspective views of curved pedal 130 of FIG. 2, FIG. 3 showing curved pedal 130 as mounted in pedal assembly 110 and FIG. 4 showing curved pedal 130 by itself. Additional reference may also be made to FIG. 10, in which like reference numerals indicate like parts.

As shown in FIG. 4, curved pedal 130 may have a length direction 132 and a width direction 133.

In one embodiment, curved pedal 130 may have an actuatable region 135 at a top surface 136 of curved pedal 130. Where this is the case, bottom surface 137 may be disposed opposite top surface 136. Thickness of curved pedal 130, i.e., the dimension shown in FIGS. 3 and 4 between top surface 136 and bottom surface 137, is preferably at least of magnitude sufficient to support and allow actuation by a foot but not so large as to impede movement of curved pedal 130. For example, where curved pedal 130 is made of 6061 or similar aluminum, thickness of curved pedal 130 might be on the order of 0.375". Note that there is no objection to employment of a curved pedal 130 of nonuniform thickness; for example, there is no objection to employment of a curved pedal 130 in which thickness varies with position in length direction 132 and/or in width direction 133. For example, in one embodiment, thickness of curved pedal 130 may vary such that bottom surface 137 is flat, e.g., where convenient for manufacture of curved pedal 130; so long as top surface 136 is curved or otherwise has curvature and/or other feature(s) as described herein, there is no particular objection to employment of any arbitrary configuration at bottom surface 137, provided that this does not impede operation of pedal assembly 110.

Although aluminum has been mentioned by way of example, curved pedal 130 may be made of any suitable material, including steel or other suitable metal, thermoplastic and/or thermosetting resin, wood, glass, ceramic, and/or the like, and may comprise any suitable laminated and/or composite material(s). Curved pedal 130 may be cast, machined, molded, formed in a vice or other such device, or manufactured and/or shaped by any other suitable technique.

Length of actuatable region 135 in length direction 132 is preferably at least long enough to permit comfortable actuation by the foot of a typical player, or by the feet of various players who may range in age from child to adult. For example, in one embodiment, length of actuatable region 135 in length direction 132 might be 5 inches to 20 inches. When length of actuatable region 135 is 5 inches to 20 inches, this may provide good but not excessive leverage for comfortable and responsive actuation of curved pedal 130. In a preferred embodiment, length of actuatable region 135 in length direction 132 is substantially longer than the foot of a typical player so as to permit increased leverage and facilitate various sliding actuation techniques. For example, in one embodiment, length of actuatable region 135 in length direction 132 is preferably not less than 12", more preferably not less than 14", and still more preferably not less than 16". Actuatable region 135 is described further below with reference to FIG. 10.

There is no particular limitation with respect to width of curved pedal 130 in width direction 133, it being sufficient that width of curved pedal 130 in width direction 133 be such as to permit comfortable actuation by the foot of a typical player, or by the feet of various players who may range in age from child to adult. Note that there is no objection to employment of a curved pedal 130 of nonuniform width; for example, there is no objection to employment of a curved pedal 130 in which width varies with position in length direction 132. For example, width of curved pedal 130 in width direction 133 may vary to accommodate the varying width of a typical foot. Furthermore, width of curved pedal 130 may narrow near the heel end and/or toe end of curved pedal 130 for convenience of mounting in pedal assembly 110 and to provide clearance with respect to support posts 124 and/or other parts.

In the embodiment shown in FIGS. 2 through 4, curved pedal 130 has actuatable region 135 comprising portion(s) 140, 150, 160 that is or are convex and/or concave relative to pedal reference plane 131. More specifically, curved pedal 130 in the embodiment shown in FIGS. 2 through 4 comprises actuatable region 135 having first convexity 140, first concavity 150, and second convexity 160. In the embodiment shown in FIGS. 2 through 4, first convexity 140, first concavity 150, and second convexity 160 are arranged in length direction 132 of actuatable region 135.

Except where stated otherwise herein, what is referred to herein as curvature of curved pedal 130 is curvature of top surface 136 thereof in length direction 132 as most easily seen in side view such as is shown in FIG. 3 and FIGS. 6 through 10. Except where stated otherwise herein, what is referred to herein as convexity or concavity of curved pedal 130 is convexity or concavity of top surface 136 thereof as viewed from a point above top surface 136 and as most easily seen in side view such as is shown in FIG. 3 and FIGS. 6 through 10.

Where curved pedal 130 contains multiple inflection points 145, 165, pedal reference plane 131 is defined as the plane that contains the best-fit line through those multiple inflection points 145, 165 as seen in a sectional view taken at a point located approximately centrally in width direction 133 of curved pedal 130 as shown in the side view of FIG. 3. Where curved pedal 130 contains less than two inflection points, pedal reference plane 131 is defined as the plane that contains the best-fit line through top surface 136 as seen in a sectional view taken at a point located approximately centrally in width direction 133 of curved pedal 130 as shown in the side view of FIG. 3.

Thus, in some embodiments, curved pedal 130 may be curved in at least a pedal length direction 132. Where this is the case, curved pedal 130 is preferably curved within at least a portion of an actuatable region 135 in the pedal length direction 132.

In one embodiment, the profile of top surface 136 of curved pedal 130 in length direction 132 has at least one inflection point 145, 165 (see FIG. 6 through 10) where curvature transitions between convex and concave, regardless of order, in length direction 132. In a preferred embodiment, there are at least two such inflection point 145, 165.

In a preferred embodiment, there are no horizontal flat portions (see FIG. 8) within at least a portion of actuatable region 135 and/or within the entire actuatable region 135. In one embodiment, slope of top surface 136 at inflection point(s) 145, 165 where curvature transitions between convex and concave in length direction 132 is preferably not less than 5°, more preferably not less than 10°, and most preferably not less than 15°.

In a preferred embodiment, there are no vertical flat portions (see FIG. 9) within at least a portion of actuatable region 135 and/or within the entire actuatable region 135. In one embodiment, slope of top surface 136 at inflection point(s) 145, 165 where curvature transitions between convex and concave in length direction 132 is preferably not greater than 85°, more preferably not greater than 80°, and most preferably not greater than 75°.

Where horizontal, vertical, and/or inclined flat portion(s) exist within actuatable region 135, these are preferably beveled or rounded so as to prevent occurrence of sharp corners 139 (see FIGS. 8 and 9) at transition(s) between flat portion(s) and convex and/or concave portion(s).

In one embodiment, local radius of curvature along top surface of curved pedal 130 within at least a portion of actuatable region 135 and/or within the entire actuatable region 135 is preferably not less than one-quarter of, more preferably not less than one-third of, and most preferably not less than one-half of the length of actuatable region 135. In a preferred embodiment, local radius of curvature along top surface of curved pedal 130 within at least a portion of actuatable region 135 and/or within the entire actuatable region 135 is preferably not less than 3", more preferably not less than 5", and most preferably not less than 7". In one embodiment, local radius of curvature along top surface of curved pedal 130 within at least a portion of actuatable region 135 and/or within the entire actuatable region 135 is preferably 8"±75%, more preferably is 8"±50%, and most preferably is 8"±25%.

In one embodiment, curved pedal 130 has smoothly varying slope within at least a portion of actuatable region 135 and/or within the entire actuatable region 135.

In one embodiment, the change in slope as a function of position along length direction 132, i.e., the second spatial derivative with respect to position in length direction 132, within at least a portion of actuatable region 135 and/or within the entire actuatable region 135 is preferably not greater than 30° per inch, more preferably not greater than 18° per inch, and most preferably not greater than 13° per inch. In one embodiment, the second spatial derivative with respect to position in length direction 132 within at least a portion of actuatable region 135 and/or within the entire actuatable region 135 is preferably 11.25° per inch±75%, more preferably is 11.25° per inch±50%, and most preferably is 11.25° per inch±25%.

In some embodiments, the profile of curved pedal 130 may be or approximate a sinusoidal curve in length direction 132 over at least a portion of actuatable region 135.

Where curved pedal 130 has such a sinusoidal profile, wavelength in length direction 132 is preferably on the order of or longer than the length of the foot of a typical player. For example, in one embodiment, wavelength of curved pedal 130 in length direction 132 is preferably 10"±50%, more preferably is 10"±25%, and most preferably is 10"±10%.

Where curved pedal 130 has such a sinusoidal profile, amplitude as measured from pedal reference plane 131 is preferably on the order of the height of the arch of the foot of a typical player. For example, in one embodiment, amplitude is preferably 0.30"±75%, more preferably is 0.30"±50%, and most preferably is 0.30"±25%.

In some embodiments, the profile of curved pedal 130 may be or may approximate a circular or elliptical arc in length direction 132 over at least a portion of actuatable region 135. Where curved pedal 130 has such an arcuate profile, radius of curvature is preferably 8"±75%, more preferably is 8"±50%, and most preferably is 8"±25%

Where curved pedal 130 has such an arcuate profile, distance between extrema 141, 161 (see FIG. 6 and FIGS. 8 through 10) of similar curvature, e.g., between successive convexities 140, 160, in length direction 132 is preferably on the order of or longer than the length of the foot of a typical player. For example, in one embodiment, interpeak distance, e.g., between first convexity extremum 141 and second convexity extremum 161, in length direction 132 is preferably 10"±50%, more preferably is 10"±25%, and most preferably is 10"±10%.

Where curved pedal 130 has such an arcuate profile, height of extrema 141, 151, 161 (see FIG. 6 and FIGS. 8 through 10) as measured from pedal reference plane 131 is preferably on the order of the height of the arch of the foot of a typical player. For example, in one embodiment, height of first convexity extremum 141, first concavity extremum 151, and/or second convexity extremum 161 as measured from pedal reference plane 131 is preferably 0.30"±75%, more preferably is 0.30"±50%, and most preferably is 0.30"±25%.

In some embodiments, the profile of curved pedal 130 may be or may approximate a polynomial curve in length direction 132 over at least a portion of actuatable region 135.

Where curved pedal 130 has such a polynomial profile, the order of the polynomial is preferably at least three, more preferably at least four, and most preferably at least five.

Where curved pedal 130 has such a polynomial profile, distance between extrema 141, 161 (see FIG. 6 and FIGS. 8 through 10, which, though not of polynomial profile, show analogous extrema 141, 161 of arcuately curved pedal 130*a*) of similar curvature, e.g., between successive convexities 140, 160, in length direction 132 is preferably on the order of or longer than the length of the foot of a typical player. For example, in one embodiment, interpeak distance, e.g., between first convexity extremum 141 and second convexity extremum 161, in length direction 132 is preferably 10"±50%, more preferably is 10"±25%, and most preferably is 10"±10%.

Where curved pedal 130 has such a polynomial profile, height of extrema 141, 151, 161 (see FIG. 6 and FIGS. 8 through 10, which, though not of polynomial profile, show analogous extrema 141, 151, 161 of arcuately curved pedal 130*a*) as measured from pedal reference plane 131 is preferably on the order of the height of the arch of the foot of a typical player. For example, in one embodiment, height of first convexity extremum 141, first concavity extremum 151, and/or second convexity extremum 161 as measured from pedal reference plane 131 is preferably 0.30"±75%, more preferably is 0.30"±50%, and most preferably is 0.30"±25%.

In some embodiments, curved pedal 130 may additionally be curved in pedal width direction 133. Where this is the case, curvature of top surface 136 in pedal width direction 133 may in some embodiments be convex, or curvature of top surface 136 in pedal width direction 133 may in other embodiments be concave. There is no particular objection to a saddle-shaped or similarly contoured curved pedal 130 in which curvature in length direction 132 may be locally opposite to curvature in width direction 133.

Although curved pedal 130 has been described with reference to FIGS. 2 through 4 in terms of an example in which actuatable region 135 is divided into three curved portions 140, 150, 160 without interposition of flat portion(s), e.g., horizontal or vertical flat portions (see FIGS. 8 and 9), at inflection points 145, 146 therebetween, actuatable region 135 may be divided into greater or fewer than three curved portion(s), and there is no particular objection to presence of flat portion(s); e.g., interposition of non-curved or flat portion(s) between respective curved portions 140, 150, 160. Although FIGS. 8 and 9 respectively show embodiments in which horizontal and vertical flat portions intervene between curved portions 140, 150, 160, in an embodiment in which flat portion(s) are present note that there is no objection to employment of flat portion(s) that are inclined with respect to pedal reference plane 131; i.e., flat as used in this context means noncurved and not necessarily that such flat portion(s) need be parallel to (horizontal) or perpendicular to (vertical) pedal reference plane 131. Where horizontal, vertical, and/or inclined flat portion(s) exist within actuatable region 135, these are preferably beveled or rounded so as to prevent occurrence of sharp corners 139 (see FIGS. 8 and 9) at transition(s) between flat portion(s) and convex and/or concave portion(s).

Referring to FIG. 5A through FIG. 5J, these show various embodiments in which actuatable region 135 has been subdivided into three portions, each of which may respectively contain a convex portion 140, 160; a concave portion 150; or a noncurved or flat portion.

Figure 5A:
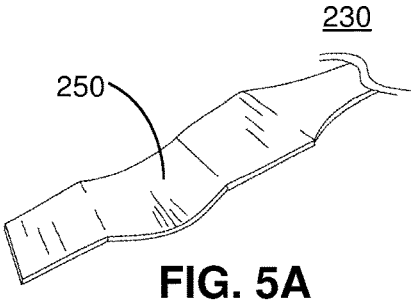
FIG. 5A through FIG. 5J show various embodiments of the present invention that are variations on curved pedal 130 of FIG. 3, FIG. 5A showing curved pedal 230 comprising first concavity 250.

In the embodiment shown in FIG. 5A, curved pedal 230 comprises first concavity 250.

Figure 5B:
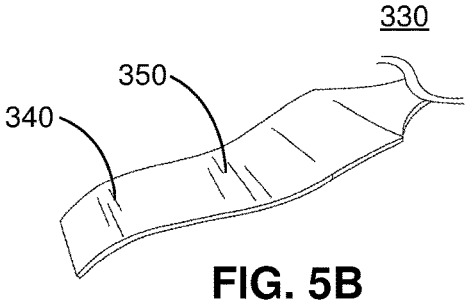

In the embodiment shown in FIG. 5B, curved pedal 330 comprises first convexity 340 and first concavity 350.

Figure 5C:
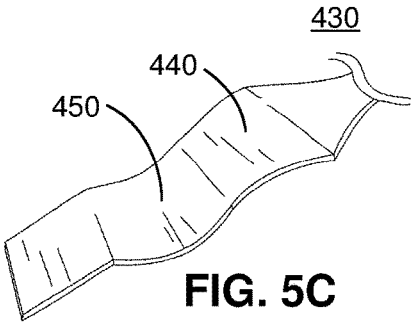

In the embodiment shown in FIG. 5C, curved pedal 430 comprises first concavity 450 and first convexity 440.

Figure 5D:
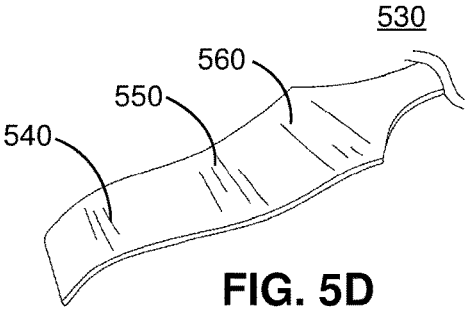

In the embodiment shown in FIG. 5D, curved pedal 530 comprises first convexity 540, first concavity 550, and second convexity 560.

Figure 5E:
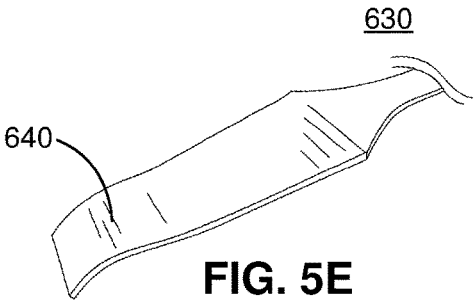

In the embodiment shown in FIG. 5E, curved pedal 630 comprises first convexity 640.

Figure 5F:
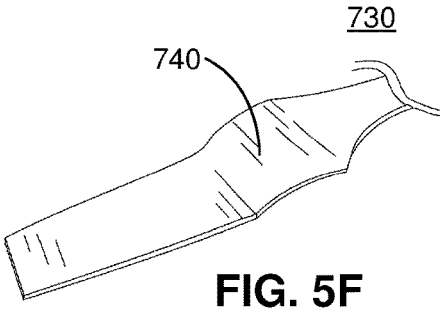

In the embodiment shown in FIG. 5F, curved pedal 730 comprises first convexity 740.

Figure 5G:
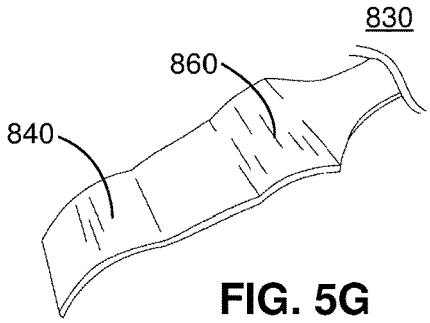

In the embodiment shown in FIG. 5G, curved pedal 830 comprises first convexity 840 and second convexity 860.

Figure 5H:
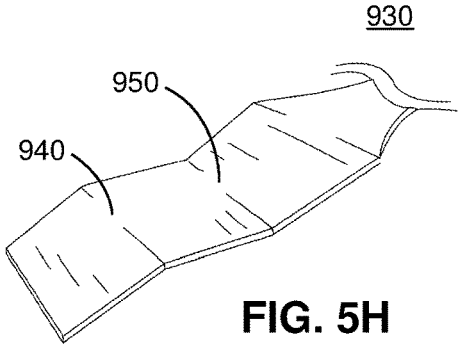

In the embodiment shown in FIG. 5H, curved pedal 930 comprises first convexity 940 and first concavity 950.

Figure 5I:
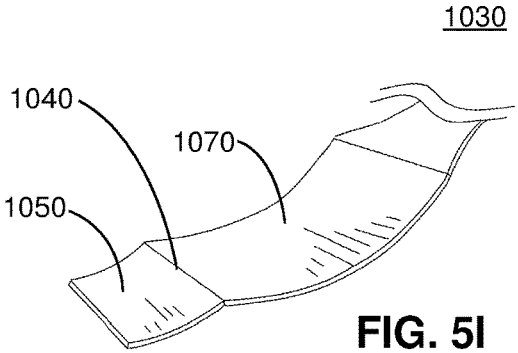

In the embodiment shown in FIG. 5I, curved pedal 1030 comprises first convexity 1040, first concavity 1050, and second concavity 1070.

Figure 5J:
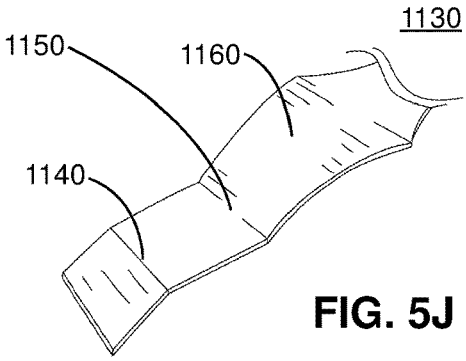

In the embodiment shown in FIG. 5J, curved pedal 1130 comprises first convexity 1140, first concavity 1150, and second convexity 1160.

Similar variations, included within the scope of the claims appended hereto, are possible when actuatable region 135 of curved pedal 130 is subdivided into greater or fewer than three portions.

Note that there is no objection to an embodiment in which convex portion(s) 140, 160, concave portion(s) 150, and/or noncurved or flat portion(s) occupy two or more of the portions into which actuatable region 135 is divided. For example, where actuatable region 135 is subdivided into three portions as shown in FIG. 5A through 5J, there is no objection to an embodiment in which first convexity 140 occupies two of the portions, and first concavity 150 occupies the remaining portion, or vice-versa. Such a variation is indicated by way of example at FIG. 5I, where second concavity 1070 occupies two of the portions into which actuatable region 135 is divided.

Note that there is no objection to combination of convex portion(s) and/or concave portion(s) with noncurved or flat portion(s), some examples of which are shown at FIGS. 5A through 5J.

Furthermore, there is no particular objection to use of angled flat portion(s) to form convex and/or concave portion(s), some examples of which are shown in FIGS. 5A through 5J. Where such angled flat portion(s) exist within actuatable region 135, these are preferably beveled or rounded so as to prevent occurrence of sharp corners 139 (see FIGS. 8 and 9) at transition(s) between flat portion(s) and convex, concave portion(s) and/or other flat portion(s).

In a preferred embodiment, at least one concave portion 150 is disposed more or less centrally in length direction 132 and/or is disposed between two convex portions 140, 160 in length direction 132.

For example, curved pedal 130 shown in FIGS. 2 through 4 and FIGS. 6 through 10 has first convexity 140, first concavity 150, and/or second convexity 160, first concavity 150 being disposed centrally between first convexity 140 and second convexity 160 along length direction 132 of actuatable region 135.

Figure 6:
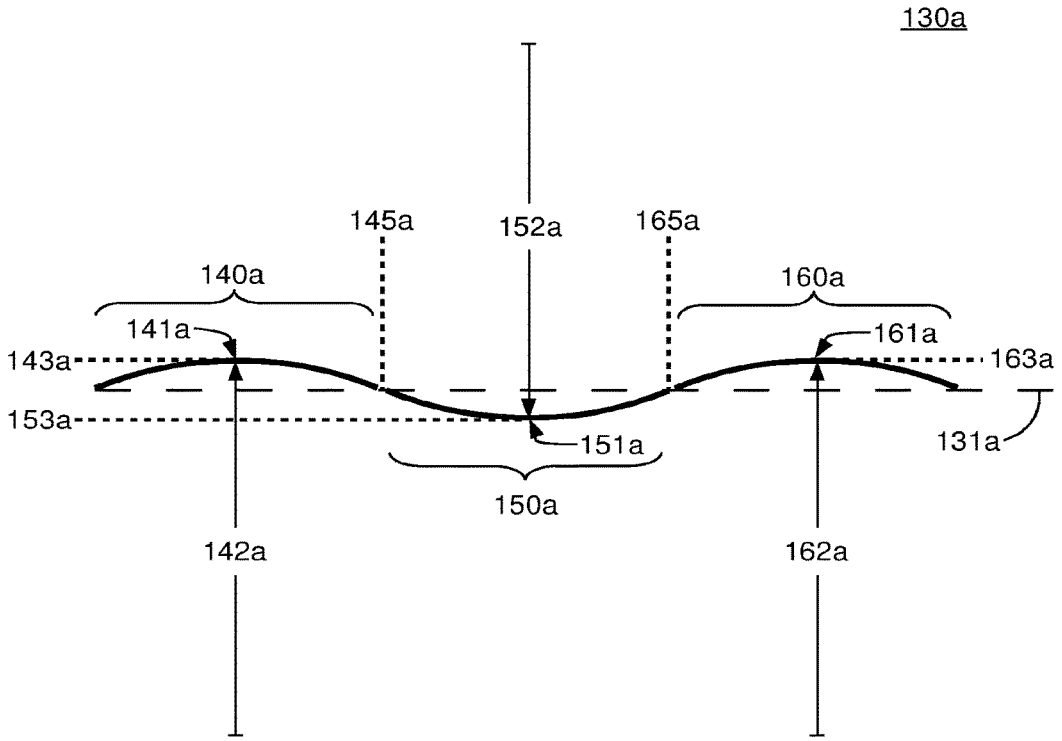
FIG. 6 is a side view of arcuately curved pedal 130*a* in an embodiment of the present invention in which first convexity 140*a*, first concavity 150*a*, and second convexity 160*a* have radii of curvature that are respectively uniform, being circular arcs, and in which arrangement and radii of curvature of first convexity 140*a*, first concavity 150*a*, and second convexity 160*a* are such as to produce smooth inflection points, without interposition of flat portions, therebetween.

Referring to FIG. 6, this is a side view of arcuately curved pedal 130*a* in an embodiment of the present invention in which first convexity 140*a*, first concavity 150*a*, and second convexity 160*a* have radii of curvature 142*a*, 152*a*, 162*a* that are respectively uniform, being circular arcs, and in which arrangement and radii of curvature 142*a*, 152*a*, 162*a* of first convexity 140*a*, first concavity 150*a*, and second convexity 160*a* are such as to produce smooth inflection points 145*a*, 165*a*, without interposition of flat portions, therebetween.

In the embodiment shown in FIG. 6, first arcuately curved convexity 140*a* has radius of curvature 142*a*, first arcuately curved concavity 150*a* has radius of curvature 152*a*, and second arcuately curved convexity 160*a* has radius of curvature 162*a*.

In the embodiment shown in FIG. 6, first arcuately curved convexity 140*a* has height (i.e., amplitude) 143*a* at extremum 141*a* as measured from pedal reference plane 131*a*. First arcuately curved concavity 150*a* has height (i.e., amplitude) 153*a* at extremum 151*a* as measured from pedal reference plane 131*a*. Second arcuately curved convexity 160*a* has height (i.e., amplitude) 143*a* at extremum 141*a* as measured from pedal reference plane 131*a*.

In the embodiment shown in FIG. 6, first convexity inflection point 145*a* is present where curvature transitions between convex and concave between first arcuately curved convexity 140*a* and first arcuately curved concavity 150*a* in length direction 132, and second convexity inflection point 165*a* is present where curvature transitions between concave and convex between first arcuately curved concavity 150*a* and second arcuately curved convexity 160 in length direction 132.

In the embodiment shown in FIG. 6, arrangement of first arcuately curved convexity 140*a*, first arcuately curved concavity 150*a*, and second arcuately curved convexity 160*a*, i.e., respective distances between extrema 141*a*, 151*a*, 161*a* and respective heights of extrema 141*a*, 151*a*, 161*a* as measured from pedal reference plane 131, and respective radii of curvature 142*a*, 152*a*, 162*a*, are chosen such that adjacent arcs of opposite curvature more or less exactly meet at inflection points 145*a*, 165*a* as to produce smooth inflection points 145*a*, 165*a* without interposition of flat portions therebetween.

Figure 7:
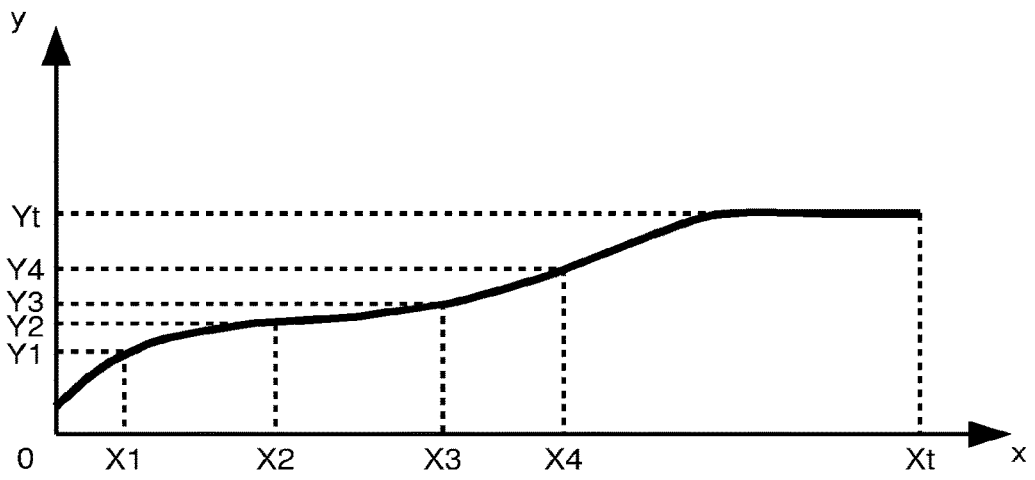
FIG. 7 is a side view of curved pedal 130 as it might exist when undepressed in pedal assembly 110 of FIG. 3, and shows inclination of extrema 141, 151, 161 and inflection points 145, 165 due to pedal mount angle 128 formed by pedal reference plane 131 and baseboard plane 113.

Referring to FIG. 7, this is a side view showing in schematic fashion how curved pedal 130, e.g., arcuately curved pedal 130*a* of the embodiment shown in FIG. 6, might appear when mounted in pedal assembly 110 of FIG. 3. In the schematic diagram of FIG. 7, curved pedal 130 is in its raised or undepressed position, being inclined more or less at pedal mount angle 128 (see FIG. 3). As indicated in the graph shown in FIG. 7, respective positions in the x and y axes of first convexity extremum 141*a*, first convexity inflection point 145*a*, first concavity extremum 151*a*, second convexity inflection point 165*a*, and second convexity extremum 161*a*-respectively indicated by indices 1, 2, 3, and 4—are inclined at pedal mount angle 128 formed by pedal reference plane 131 and baseboard plane 113.

Figure 8:
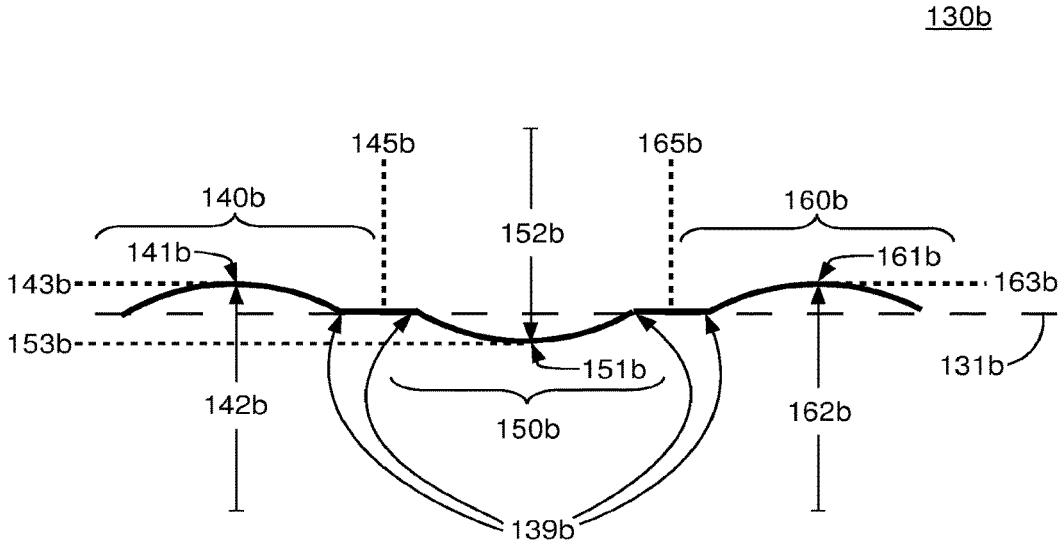
FIG. 8 is a side view of arcuately curved pedal 130*b* in an embodiment of the present invention in which first convexity 140*b*, first concavity 150*b*, and second convexity 160*b* have radii of curvature that are respectively uniform, being circular arcs, and in which arrangement and radii of curvature of first convexity 140*b*, first concavity 150*b*, and second convexity 160*b* are such as to accommodate interposition of horizontal flat portions at inflection points therebetween as a result of the smaller radii of curvature in the embodiment shown in FIG. 8 as compared with the embodiment shown in FIG. 6.

Referring to FIG. 8, this is a side view of arcuately curved pedal 130*b* in an embodiment of the present invention in which first convexity 140*b*, first concavity 150*b*, and second convexity 160*b* have radii of curvature 142*b*, 152*b*, 162*b* that are respectively uniform, being circular arcs, and in which arrangement and radii of curvature 142*b*, 152*b*, 162*b* of first convexity 140*b*, first concavity 150*b*, and second convexity 160*b* are such as to accommodate interposition of horizontal flat portions at inflection points 145*b*, 165*b* therebetween as a result of the smaller radii of curvature 142*b*, 152*b*, 162*b* in the embodiment shown in FIG. 8 as compared with the radii of curvature 142*a*, 152*a*, 162*a* employed in the embodiment shown in FIG. 6.

Note that where corner(s) 139*b* are produced at transition(s) between flat portion(s) and convex and/or concave portion(s), it is preferred that these be beveled or rounded so that local radius of curvature is not substantially smaller than radius of curvature at other locations along the curved profile at top surface 136 of curved pedal 130. In a preferred embodiment, radii of curvature at corner(s) 139*b* at transition(s) between flat portion(s) and convex and/or concave portion(s) are preferably not less than 3", more preferably not less than 5", and most preferably not less than 7".

Figure 9:
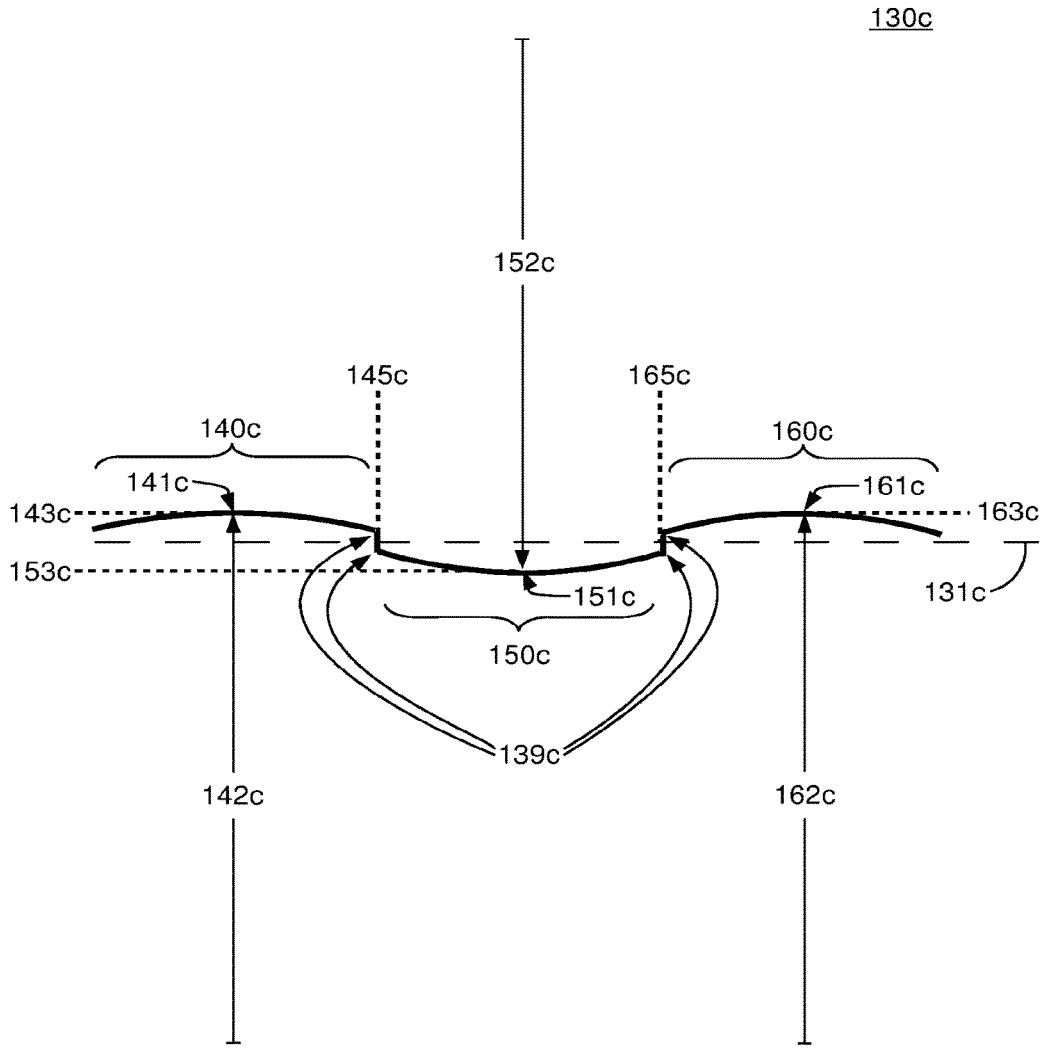
FIG. 9 is a side view of arcuately curved pedal 130*c* in an embodiment of the present invention in which first convexity 140*c*, first concavity 150*c*, and second convexity 160*c* have radii of curvature that are respectively uniform, being circular arcs, and in which arrangement and radii of curvature of first convexity 140*c*, first concavity 150*c*, and second convexity 160*c* are such as to accommodate interposition of vertical flat portions at inflection points therebetween as a result of the larger radii of curvature in the embodiment shown in FIG. 9 as compared with the embodiment shown in FIG. 6.

Referring to FIG. 9, this is a side view of arcuately curved pedal 130*c* in an embodiment of the present invention in which first convexity 140*c*, first concavity 150*c*, and second convexity 160*c* have radii of curvature 142*c*, 152*c*, 162*c* that are respectively uniform, being circular arcs, and in which arrangement and radii of curvature 142*c*, 152*c*, 162*c* of first convexity 140*c*, first concavity 150*c*, and second convexity 160*c* are such as to accommodate interposition of vertical flat portions at inflection points 145*c*, 165*c* therebetween as a result of the larger radii of curvature 142*c*, 152*c*, 162*c* in the embodiment shown in FIG. 9 as compared with the radii of curvature 142*a*, 152*a*, 162*a* employed in the embodiment shown in FIG. 6.

Note that where corner(s) 139*c* are produced at transition(s) between flat portion(s) and convex and/or concave portion(s), it is preferred that these be beveled or rounded so that local radius of curvature is not substantially smaller than radius of curvature at other locations along the curved profile at top surface 136 of curved pedal 130. In a preferred embodiment, radii of curvature at corner(s) 139*c* at transition(s) between flat portion(s) and convex and/or concave portion(s) are preferably not less than 3", more preferably not less than 5", and most preferably not less than 7".

Figure 10:
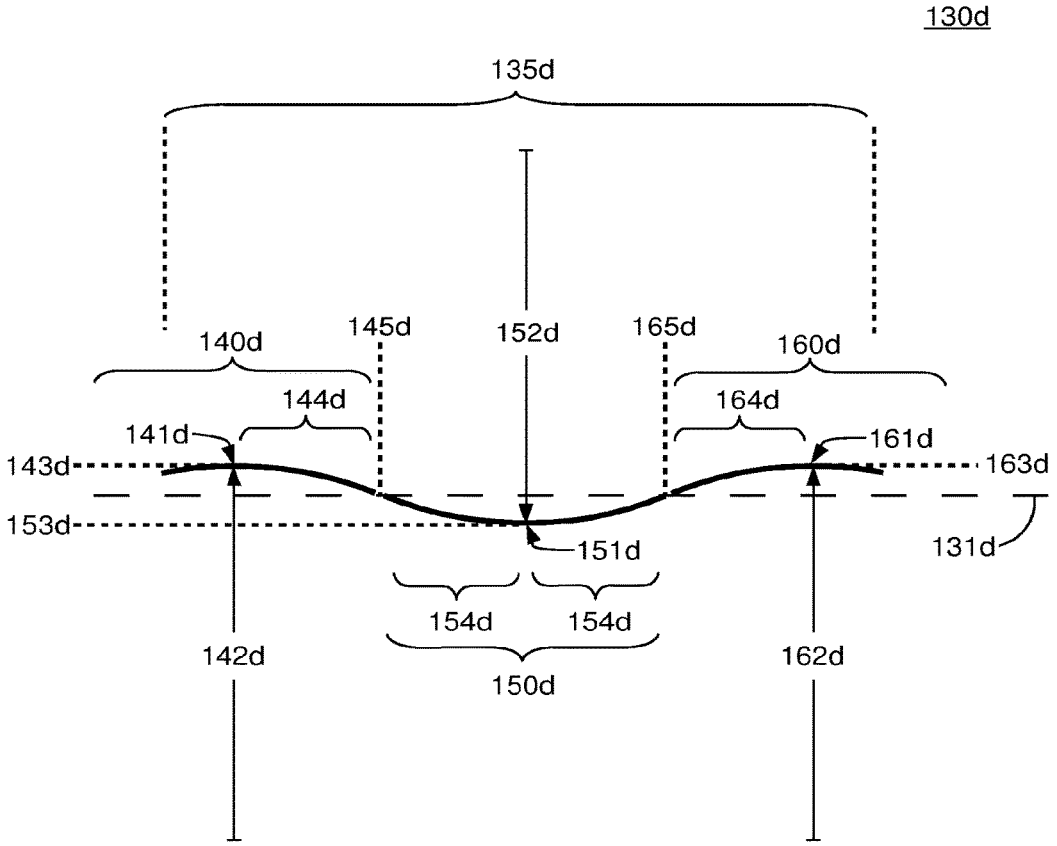
FIG. 10 is a side view of arcuately curved pedal 130*d*, which is identical to arcuately curved pedal 130*a* of FIG. 6 except that portions peripheral to actuatable region 135*d* have been removed so as to draw attention to first convexity half-lobe 144*d*, first concavity half-lobes 154*d*, and second convexity half-lobe 164*d* within actuatable region 135*d*.

Referring to FIG. 10, this is a side view of arcuately curved pedal 130*d*, which is identical to arcuately curved pedal 130*a* of FIG. 6 except that portions peripheral to actuatable region 135*d* have been removed, leaving substantially first convexity half-lobe 144*d*, first concavity half-lobes 154*d*, and second convexity half-lobe 164*d* within actuatable region 135*d*.

Whereas curved pedal 130 shown in FIGS. 2 through 4 and FIGS. 6 through 9 is divided into three curved portions 140, 150, 160, actuatable region 135, i.e., the region contacted by the foot during playing, may in some embodiments not extend all the way to the peripheral ends of first convexity 140 and second convexity 160.

That is, in embodiments in which there is a central concavity 150 and/or a concavity 150 disposed between two convexities 140, 160, it may primarily be the central concavity 150 that serves to locate or orient the foot, while the convexities 140, 160 to either side thereof might typically primarily serve to receive striking force from the heel and/or toe. This being the case, in such an embodiment, it may be that it is primarily only the central or interior first convexity half-lobe 144*d* which is disposed between extremum 141*d* and inflection point 145*d* of first convexity 140*d* that is required for actuation, and it may be that it is primarily only the central or interior second convexity half-lobe 164*d* which is disposed between extremum 161*d* and inflection point 165*d* of second convexity 160*d* that is required for actuation.

For this reason, actuatable region 135*d* of curved pedal 130*d* is shown in FIG. 10 as extending only slightly peripherally past first convexity extremum 141*d* at the heel side (left side in FIG. 10) of curved pedal 130*d*, and as extending only slightly peripherally past second convexity extremum 161*d* at the toe side (right side in FIG. 10) of curved pedal 130*d*.

That is, actuatable region 135*d* of curved pedal 130*d* in the embodiment shown in FIG. 10 comprises the two half-lobes 154*d* of central concavity 150*d* but only substantially the interior half-lobe 144*d* of first convexity 140*d* and only substantially the interior half-lobe 164*d* of second convexity 160*d*. Note that in a preferred embodiment, actuatable region 135*d* extends peripherally slightly past first convexity extremum 141*d* to comprise a small portion of what would be the exterior half-lobe of first convexity 140*d*, and extends peripherally slightly past second convexity extremum 161*d* to comprise a small portion of what would be the exterior half-lobe of second convexity 160*d*.

In one embodiment, actuatable region 135*d* preferably extends peripherally not more than 25%, more preferably not more than 15%, and most preferably not more than 10%, past first convexity extremum 141*d*. In one embodiment, actuatable region 135*d* preferably extends peripherally not more than 25%, more preferably not more than 15%, and most preferably not more than 10%, past second convexity extremum 161*d*.

And in an embodiment in which it is desirable that that convex portion(s) 140, 160 be at least minimally well-defined, actuatable region 135*d* in such an embodiment preferably extends peripherally not less than 15%, more preferably not less than 10%, and most preferably not less than 5%, past first convexity extremum 141, and/or actuatable region 135*d* in such an embodiment preferably extends peripherally not less than 15%, more preferably not less than 10%, and most preferably not less than 5%, past second convexity extremum 161*d*.

Here, the degree to which actuatable region 135*d* extends peripherally past an extremum is measured as the distance from the projection of the extremum onto pedal reference plane 131*d* to the projection of the most peripheral point of actuatable region 135*d* onto pedal reference plane 131*d*.

Although the profiles of first convexity 140*a*, 140*b*, 140*c*, 140*d*; first concavity 150*a*, 150*b*, 150*c*, 150*d*; and second convexity 160*a*, 160*b*, 160*c*, 160*d* in the embodiments shown in FIGS. 6, 8, 9 and 10 are circular arcs, there is no objection to employment of elliptical arc(s), conic section(s), and/or any suitable portion(s) of Bezier curve(s) at one or more of first convexity 140*a*, first concavity 150*a*, and second convexity 160*a*, or at any suitable portion(s) thereof.

Furthermore, as described with reference to FIGS. 11 through 15, any of various sinusoidal and/or polynomial profiles may be employed at one or more of first convexity 140*a*, 140*b*, 140*c*, 140*d*; first concavity 150*a*, 150*b*, 150*c*, 150*d*; and second convexity 160*a*, 160*b*, 160*c*, 160*d*, or at any suitable portion(s) thereof.

Moreover, curvature profile need not be uniform throughout actuatable region 135 along length direction 132 of curved pedal 130 it being possible, for example, to employ respectively different curvature profiles at curved portions 140, 150, 160. Furthermore, curvature profile need not be uniform within each of respective curved portions 140, 150, 160, it being possible, for example, to employ different curvature profiles at respective half-lobe(s) 144, 154, 164 therewithin.

Figure 11:
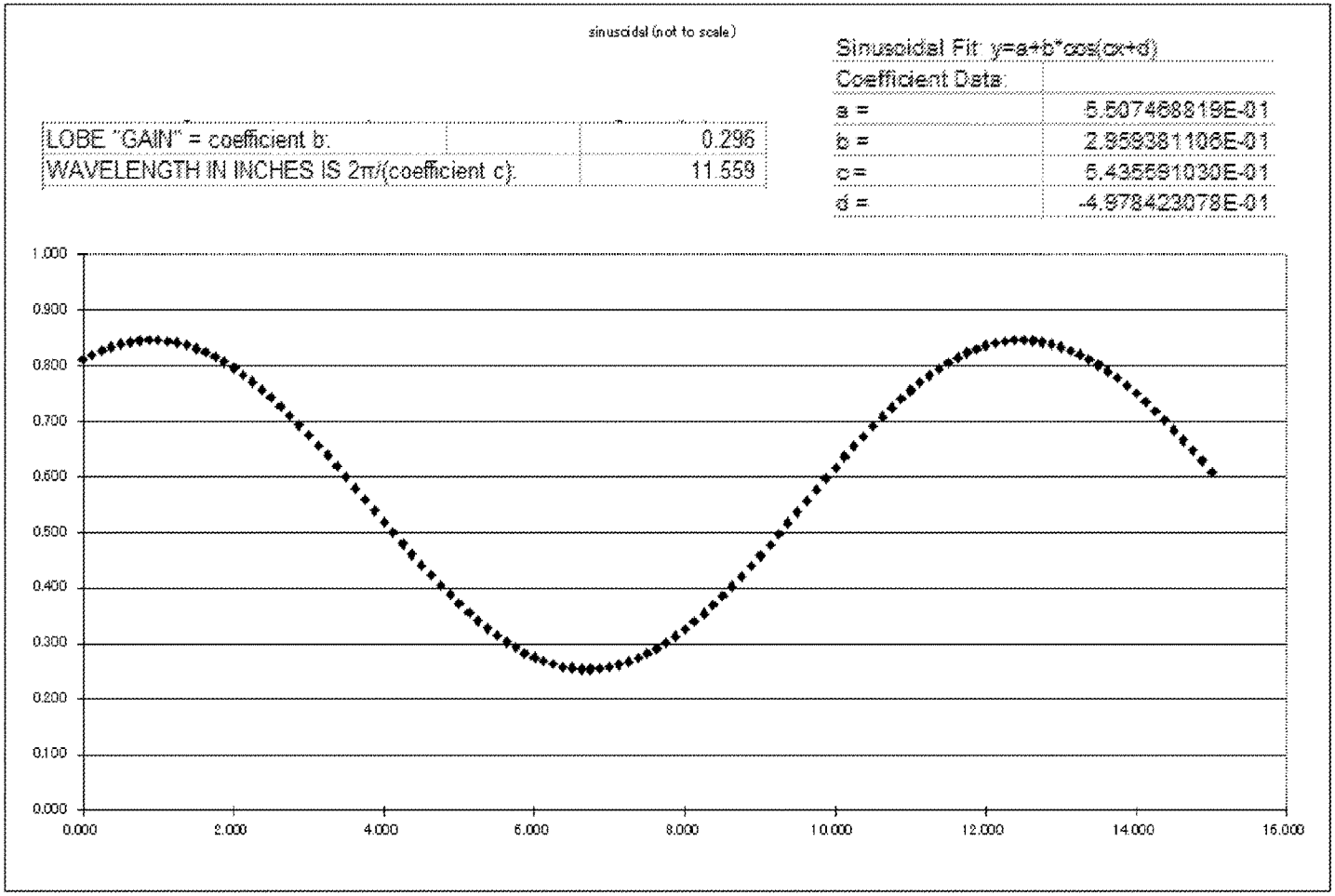
FIG. 11 shows a working example in which top surface 136 of curved pedal 130 has a uniform sinusoidal profile of wavelength 11.6" and amplitude 0.30" throughout actuatable region 135 in length direction 132.

FIG. 11 shows a working example in which top surface 136 of curved pedal 130 has a uniform sinusoidal profile of wavelength 11.6" and amplitude 0.30" throughout actuatable region 135 in length direction 132. The sinusoidal profile shown in FIG. 11 was derived by curvefitting a sinusoidal function to data measured from a prototype constructed by the inventor. More specifically, the curvature profile shown in FIG. 11 is a graph of the equation y=a+b*cos(cx+d), where coefficients a through d are: a=5.507468819E-01; b=2.959381106E-01; c=5.435591030E-01; and d=−4.978423078E-01.

Figure 12A:
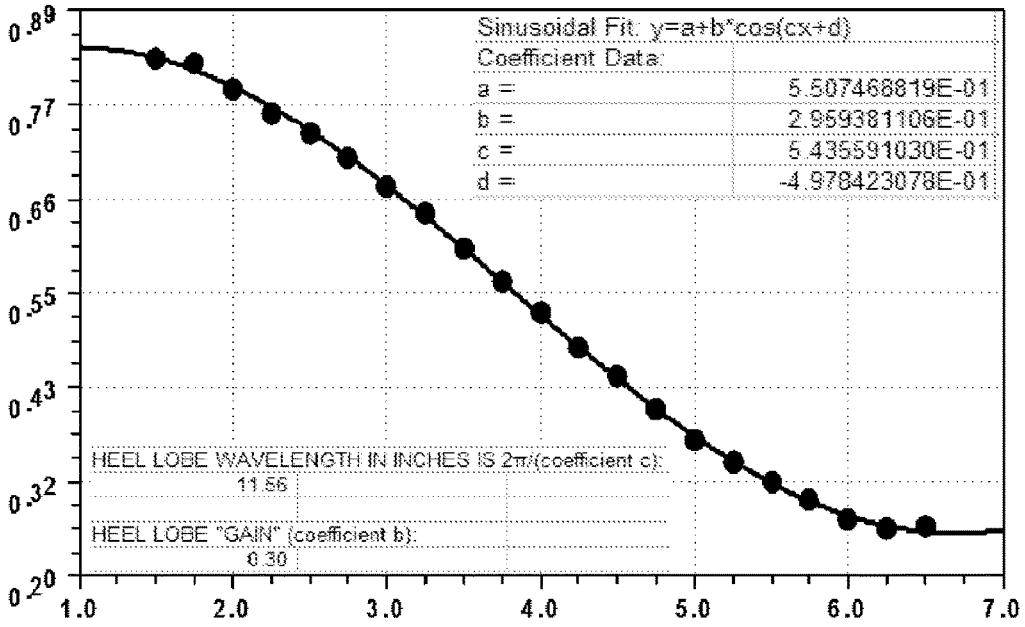
FIGS. 12A and 12B show a working example in which top surface 136 of curved pedal 130 has a varying sinusoidal profile within actuatable region 135 in length direction 132, the combined portion comprising first convexity half-lobe 144 and first concavity heel-side half-lobe 154 having a sinusoidal profile of wavelength 11.6" and amplitude 0.30" as shown in FIG. 12A, and the combined portion comprising first concavity toe-side half-lobe 154 having a sinusoidal profile of wavelength 8.4" and amplitude 0.21" as shown in FIG. 12B.
Figure 12B:
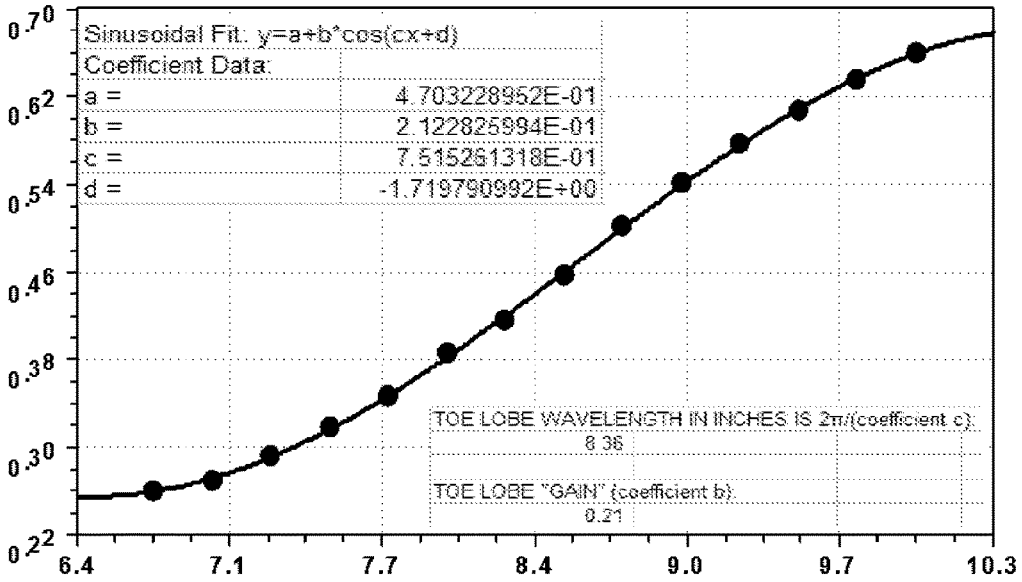

FIGS. 12A and 12B show a working example in which top surface 136 of curved pedal 130 has a varying sinusoidal profile within actuatable region 135 in length direction 132, the combined portion comprising first convexity half-lobe 144 and first concavity heel-side half-lobe 154 having a sinusoidal profile of wavelength 11.6" and amplitude 0.30" as shown in FIG. 12A, and the combined portion comprising first concavity toe-side half-lobe 154 having a sinusoidal profile of wavelength 8.4" and amplitude 0.21" as shown in FIG. 12B. The sinusoidal profiles shown in FIGS. 12A and 12B were derived by curvefitting sinusoidal functions to data measured from a prototype constructed by the inventor. More specifically, the curvature profile shown in FIG. 12A is a graph of the equation y=a+b*cos(cx+d), where coefficients a through d are: a=5.507468819E-01; b=2.959381106E-01; c=5.435591030E-01; and d=−4.978423078E-01. Likewise, the curvature profile shown in FIG. 12B is a graph of the equation y=a+b*cos(cx+d), where coefficients a through d are: a=4.703228952E-01; b=2.122825994E-01; c=7.515261318E-01; and d=−1.719790992E+00.

Figure 13:
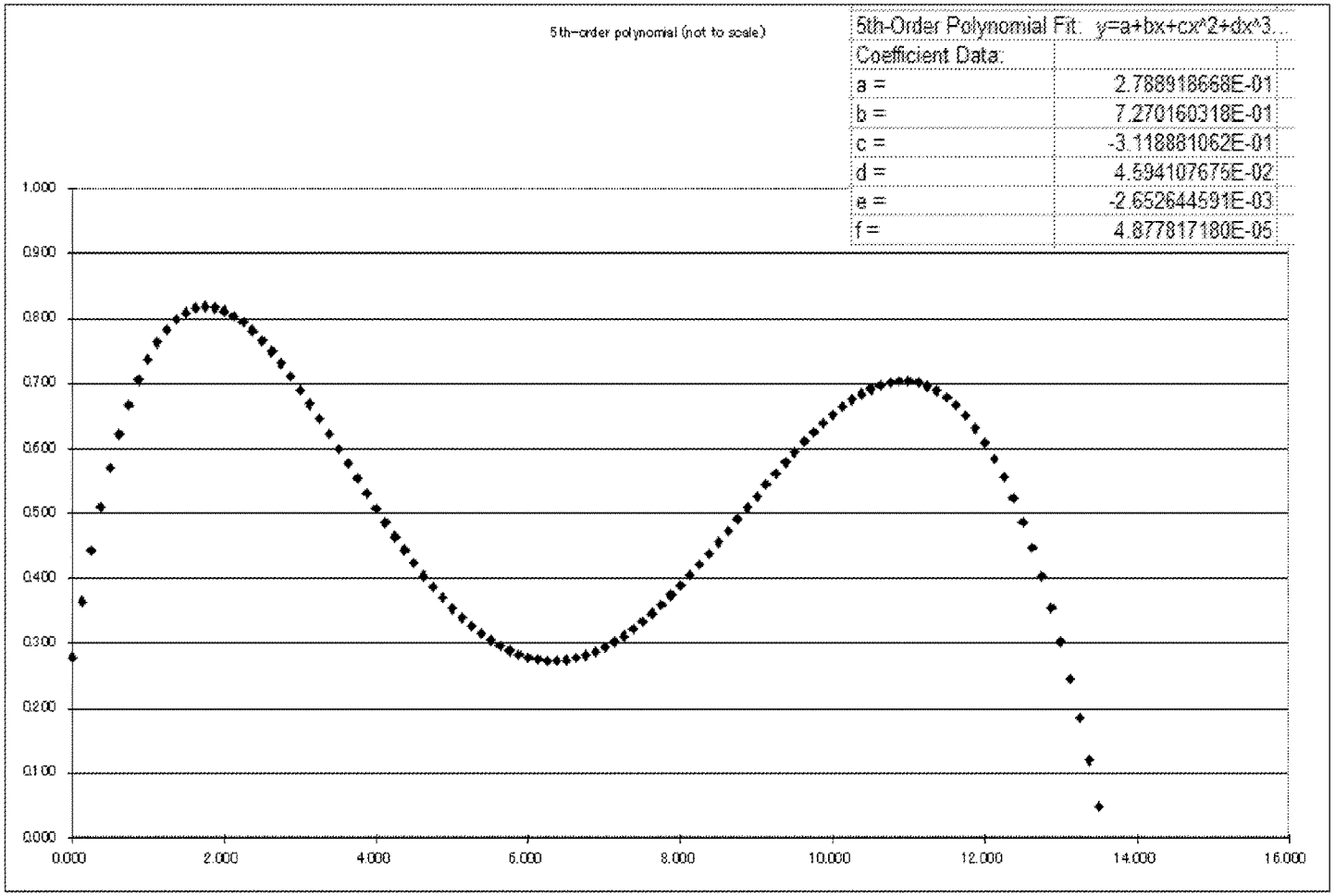
FIG. 13 shows a working example in which top surface 136 of curved pedal 130 has a 5th-order polynomial profile throughout actuatable region 135 in length direction 132.

FIG. 13 shows a working example in which top surface 136 of curved pedal 130 has a 5th-order polynomial profile throughout actuatable region 135 in length direction 132. The 5th-order polynomial profile shown in FIG. 13 was derived by curvefitting a 5th-order polynomial function to data measured from a prototype constructed by the inventor. More specifically, the curvature profile shown in FIG. 13 is a graph of the equation y=a+bx+cx^2+dx^3+ex^4+fx^5, where coefficients a through f are: a=2.788918668E-01; b=7.270160318E-01; c=−3.118881062E-01; d=4.594107675E-02; e=−2.652644591E-03; and f=4.877817180E-05.

Figure 14A:
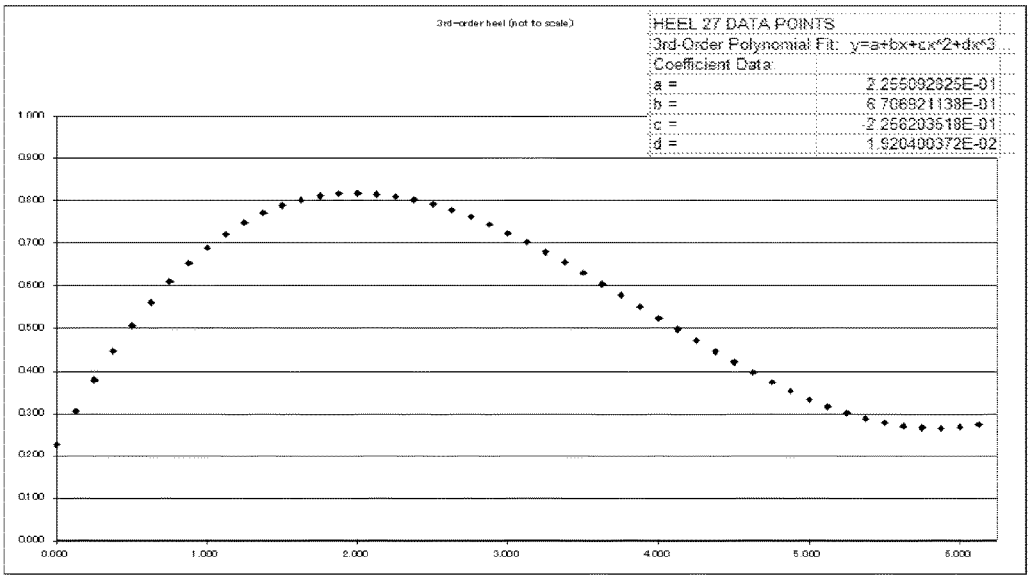
FIGS. 14A and 14B show a working example in which top surface 136 of curved pedal 130 has a varying 3rd-order polynomial profile within actuatable region 135 in length direction 132, the combined portion comprising first convexity half-lobe 144 and first concavity heel-side half-lobe 154 having a 3rd-order polynomial profile as shown in FIG. 14A, and the combined portion comprising first concavity toe-side half-lobe 154 having a 3rd-order polynomial profile as shown in FIG. 14B.
Figure 14B:
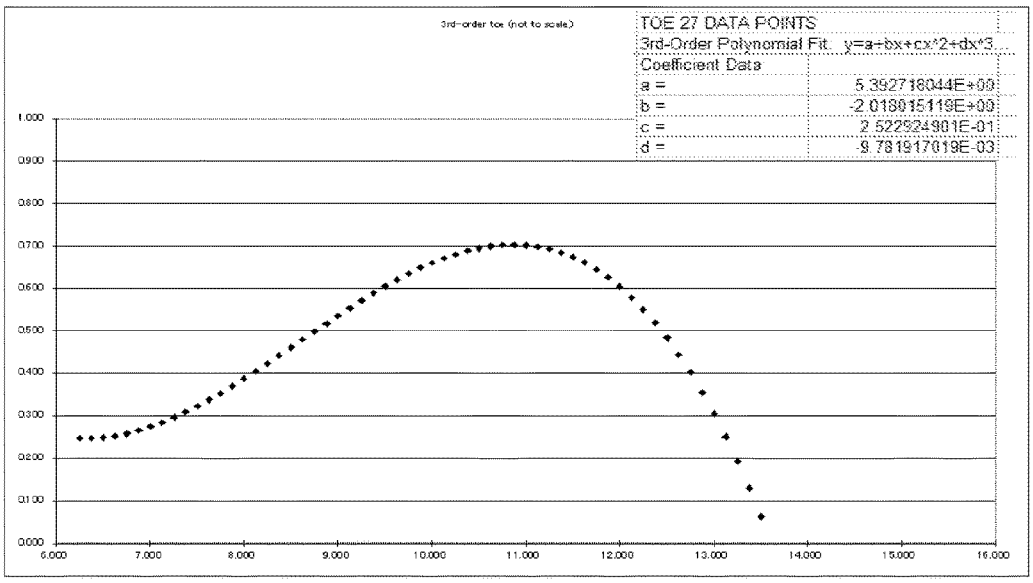

FIGS. 14A and 14B show a working example in which top surface 136 of curved pedal 130 has a varying 3rd-order polynomial profile within actuatable region 135 in length direction 132, the combined portion comprising first convexity half-lobe 144 and first concavity heel-side half-lobe 154 having a 3rd-order polynomial profile as shown in FIG. 14A, and the combined portion comprising first concavity toe-side half-lobe 154 having a 3rd-order polynomial profile as shown in FIG. 14B. The 3rd-order polynomial profiles shown in FIGS. 14A and 14B were derived by curvefitting 3rd-order polynomial functions to data measured from a prototype constructed by the inventor. More specifically, the curvature profile shown in FIG. 14A is a graph of the equation y=a+bx+cx^2+dx^3, where coefficients a through d are: a=2.255092825E-01; b=6.706921138E-01; c=−2.258203518E-01; and d=1.920400372E-02. Likewise, the curvature profile shown in FIG. 14B is a graph of the equation y=a+bx+cx^2+dx^3, where coefficients a through d are: a=5.392718044E+00; b=−2.018015119E+00; c=2.522924901E-01; and d=−9.781917019E-03.

Figure 15A:
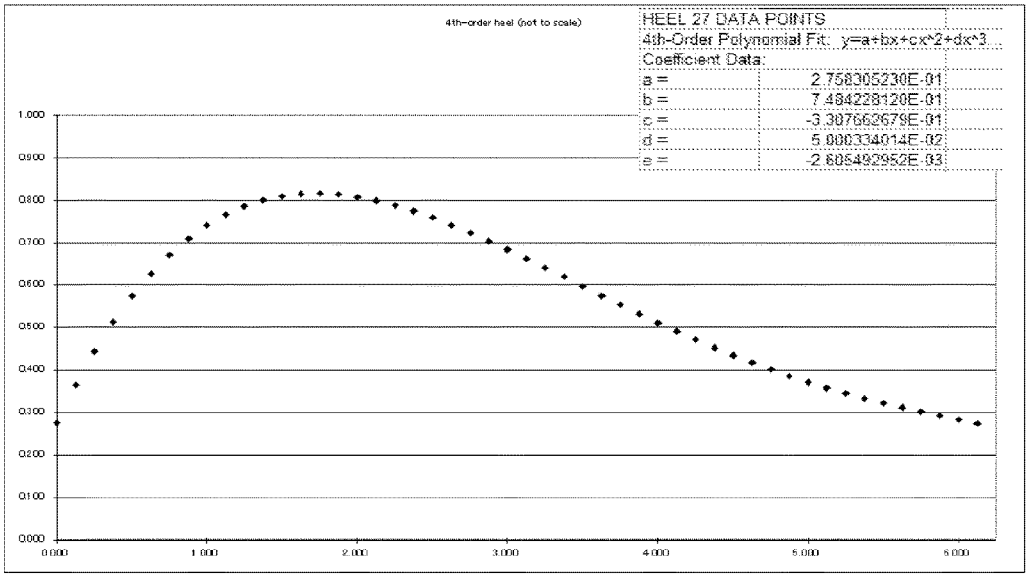
FIGS. 15A and 15B show a working example in which top surface 136 of curved pedal 130 has a varying 4th-order polynomial profile within actuatable region 135 in length direction 132, the combined portion comprising first convexity half-lobe 144 and first concavity heel-side half-lobe 154 having a 4th-order polynomial profile as shown in FIG. 15A, and the combined portion comprising first concavity toe-side half-lobe 154 having a 4th-order polynomial profile as shown in FIG. 15B.
Figure 15B:
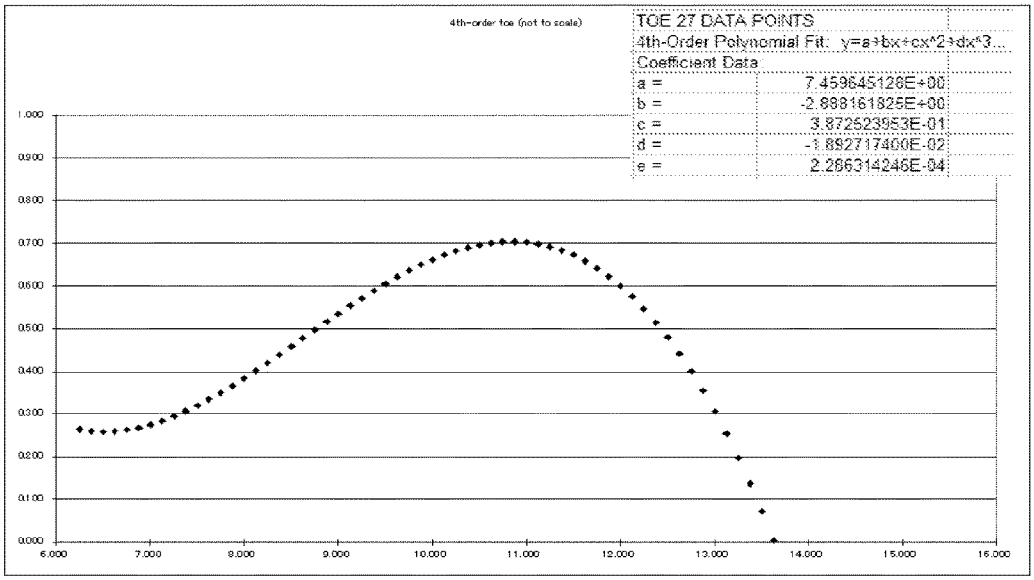

FIGS. 15A and 15B show a working example in which top surface 136 of curved pedal 130 has a varying 4th-order polynomial profile within actuatable region 135 in length direction 132, the combined portion comprising first convexity half-lobe 144 and first concavity heel-side half-lobe 154 having a 4th-order polynomial profile as shown in FIG. 15A, and the combined portion comprising first concavity toe-side half-lobe 154 having a 4th-order polynomial profile as shown in FIG. 15B. The 4th-order polynomial profiles shown in FIGS. 15A and 15B were derived by curvefitting 4th-order polynomial functions to data measured from a prototype constructed by the inventor. More specifically, the curvature profile shown in FIG. 15A is a graph of the equation y=a+bx+cx^2+dx^3+ex^4, where coefficients a through e are: a=2.758305230E-01; b=7.484228120E-01; c=−3.307662679E-01; d=5.000334014E-02; and e=−2.605492952E-03. Likewise, the curvature profile shown in FIG. 15B is a graph of the equation y=a+bx+cx^2+dx^3+ex^4, where coefficients a through e are: a=7.459645128E+00; b=−2.888161825E+00; c=3.872523953E-01; d=−1.892717400E-02; and e=2.286314246E-04.

Note that the present invention is not limited to the working examples described with reference to FIGS. 11 through 15, these merely being exemplary profiles within the ranges of the various parameters—e.g., wavelength, amplitude, interpeak distance and/or distance between extrema, extrema amplitude and/or height as measured from pedal reference plane 131, and radii of curvature—as claimed and/or as described elsewhere in this specification.

Note further that although working examples shown in FIGS. 12 through 15 employ different or asymmetric amplitudes or gains at first convexity 140 and second convexity 160, while the working example shown in FIG. 11 and in the embodiments described with reference to FIGS. 3 through 10 generally employed symmetric amplitudes or gains at first convexity 140 and second convexity 160, there is in general no objection to employment of symmetric or asymmetric amplitudes or gains and/or symmetric or asymmetric values for any of the various other parameters at first convexity 140, first concavity 150, and second convexity 160 within the ranges of the various parameters—e.g., wavelength, amplitude, interpeak distance and/or distance between extrema, extrema amplitude and/or height as measured from pedal reference plane 131, and radii of curvature—as claimed and/or as described elsewhere in this specification.

As described above, curved pedal 130 of various embodiments of the present invention may be mounted in pedal assembly 110 for use in drum set 100, for example.

Curved pedal 130 mounted in pedal assembly 110 for use in drum set 100 in accordance with embodiments of the present invention may facilitate pedal-actuated drumming and/or may make pedal-actuated drumming less tiring or more comfortable, especially when employing techniques such as the sliding technique and/or the heel-toe technique.

Furthermore, the curved shape of curved pedal 130 in accordance with some embodiments may allow a player to quickly and reliably locate his or her foot by the "feel" of curved pedal 130.

Moreover, because curved pedal 130 in accordance with some embodiments may be a good match for the shape of the foot, employment of curved pedal 130 may make it possible to achieve more rapid and powerful striking of the drum with less movement of the foot and/or ankle than is the case conventionally.

In addition, the curved shape of curved pedal 130 in accordance with some embodiments may allow the foot—and in particular the heel of the foot and/or the ball of the foot—to strike curved pedal 130 at an angle more nearly perpendicular to top surface 136 thereof, making it possible to improve the leverage or efficiency with which force is transferred from the player's foot to curved pedal 130, and/or permitting stronger and/or less tiring performance.

Furthermore, the smoothly varying contour of curved pedal 130 in some embodiments may be advantageous for players who employ bare feet or who wears socks but no shoes or who wears thin shoes or other such foot coverings for improved comfort and sensitivity in locating the foot on curved pedal 130.

Moreover, because actuatable region 135 of curved pedal 130 in some embodiments is substantially longer than the foot of the player, this may not only permit increase in leverage about the fulcrum of heel hinge 114, permitting more powerful and/or less tiring playing, but may also facilitate more sustained sliding along length direction 132 of curved pedal 130. In addition, a pedal substantially longer than the foot of the player may also accommodate multiple striking locations beyond the basic heel-toe striking positions employed conventionally.

Figure 16A:
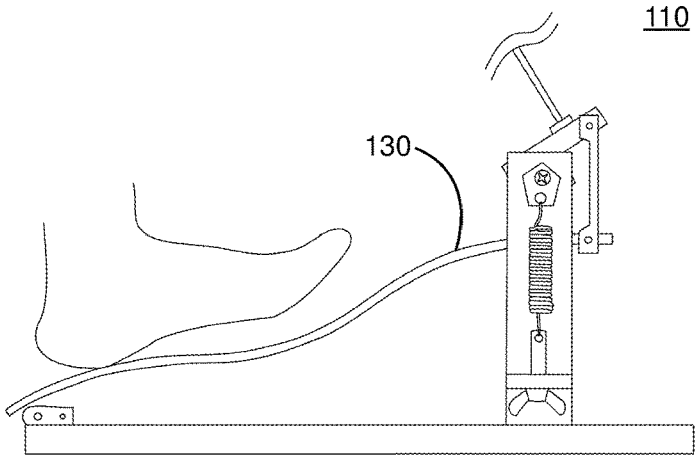
FIGS. 16A through 16C are diagrams to assist in describing one example of use of curved pedal 130 in pedal assembly 110 in accordance with an embodiment of the present invention.
Figure 16B:
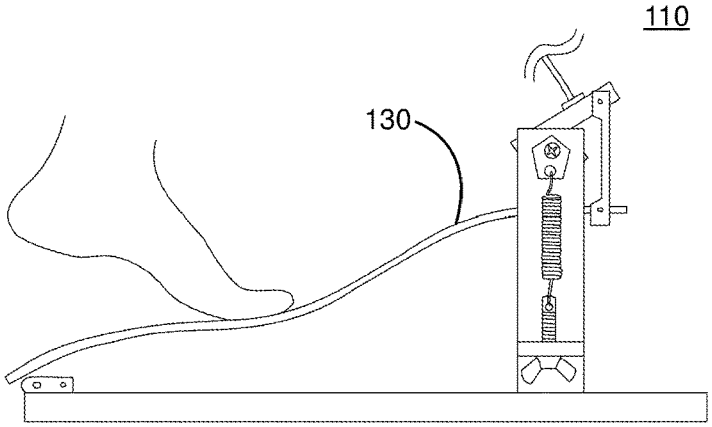
Figure 16C:
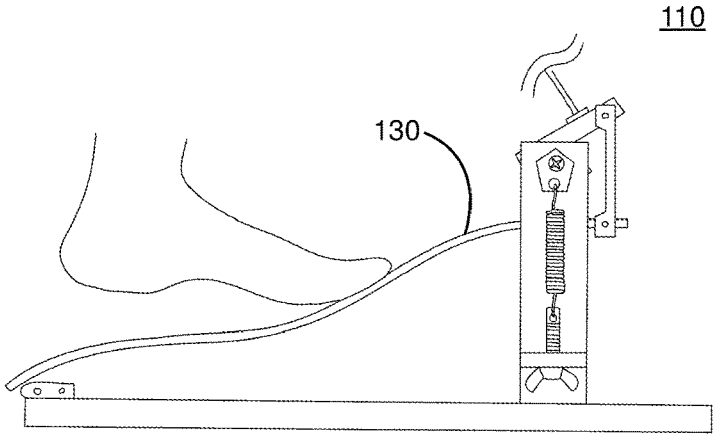

Referring now to FIGS. 16A through 16C, description will be given of how curved pedal 130 in pedal assembly 110 at drum set 100 might be used accordance with an embodiment of the present invention.

At drum set 100, pedal assembly 110 may be used to play a drum 103 or high-hat cymbals 104, for example, in any suitable manner. For example, where pedal assembly 110 is used to operate bass drum 103, pedal assembly 110 may be assembled in such fashion as to permit pedal assembly 110 to cause beater 115 to strike vertically standing drum 103 or a horizontally standing drum when curved pedal 130 is depressed.

In some embodiments, a player may use pedal assembly 110 to generate a single drum beat. At such time, when the player uses his or her foot to operate pedal assembly 110, the foot may in general be positioned at any arbitrary location along top surface 136 of curved pedal 130 at the time that curved pedal 130 is depressed. For example, the foot may be positioned as shown in FIG. 16A. In another example, the foot may be positioned as shown in FIG. 16B. In yet another example, the foot may be positioned as shown in FIG. 16C. Possible foot positions are not limited to those shown in FIG. 16A through FIG. 16C.

In some embodiments, a player may use pedal assembly 110 to generate a doublet, or two consecutive drum beats. A doublet may be generated in various ways. For example, a player may simply repeat one of the foot movements mentioned above to generate a single drum beat twice in rapid succession. One advantage of some embodiments of the present invention is that it facilitates production of two consecutive drum beats in one foot motion cycle. When two consecutive beats are produced by one foot motion cycle, rapid consecutive beats may be easily achieved.

For example, in accordance with one or more embodiments of the present invention, a player may use any of various sliding techniques. In accordance with one such sliding technique, a player might first depress curved pedal 130 using his or her toe to generate a first stroke, slide his or her foot along length direction 132 of curved pedal 130, and then depress curved pedal 130 again using his or her toe to generate a second stroke. For example, a foot may be positioned for a first toe stroke as shown in FIG. 16B and then for a second toe stroke as shown in FIG. 16C. Alternatively, a foot may be positioned for a first toe stroke as shown in FIG. 16C and then for a second toe stroke as shown in FIG. 16B. Possible foot positions are not limited to those described in FIG. 16B and FIG. 16C.

One advantage of at least some embodiments of the present invention is that the curved top surface 136 of curved pedal 130 may be better suited for foot sliding motion and therefore permit easier and less tiring generation of doublets, for example, as compared with a conventional flat pedal.

For example, when toe positions for two consecutive toe strokes are in a curved region of curved pedal 130, e.g., within first concavity 150, the curved shape of top surface 136 of curved pedal 130 may allow a player to more easily slide his or her toe forward or backward along length direction 132 as the toe depresses curved pedal 130.

Furthermore, employment of a curved pedal 130 having smoothly varying slope within at least a portion of actuatable region 135 and/or within the entire actuatable region 135 may make it possible for a player to be able to feel on his or her foot a gradual local angle shift, i.e., slope change, of curved pedal 130 during foot sliding motion, and a player may use this shift as an indicator to understand where his or her toe is positioned during a foot motion cycle. The shift that may be felt on a player's foot may make reproducing a foot motion cycle easier for the player. In particular, where curved pedal 130 has second convexity 160, the curvature of second convexity 160 may provide further toe positioning guidance. Thus, the smoothly varying slope of curved pedal 130 may allow a player to better rely on the feel of the foot and to eliminate or reduce the need to focus on how far the foot should slide, which may make generating a doublet, for example, more reproducible, less tiring, and more enjoyable.

Thus, one advantage of at least some embodiments of the present invention is that curved pedal 130 may make foot tilting motion and hence doublet generation easy and less tiring as compared with a conventional flat pedal. For example, when curved pedal 130 has at least one convexity 140, 160, this may permit a player to be better able to feel on his or her toe a gradual local angle shift, slope change, within first convexity 140, so as to allow easy positioning of a heel for a heel stroke, for example.

As another example of a technique that may be employed, a player may use a heel-toe technique and/or toe-heel technique.

In one such heel-toe technique, a player may first depress curved pedal 130 with his or her heel to generate a first stroke, tilt his or her toe down, and then depress curved pedal 130 with his or her toe to generate a second stroke. For example, a heel may be positioned for a first stroke as shown in FIG. 16A and then for a second stroke as shown in FIG. 16B or FIG. 16C.

In one such toe-heel technique, a toe stroke may be a first stroke and a heel stroke may be a second stroke. For example, the toe may be positioned for a first stroke as shown in FIG. 16B or 16C, and then the heel may be positioned for a second stroke as shown in FIG. 16A. Possible foot positions are not limited to those described in FIG. 16B and FIG. 16C.

In some embodiments, a player may use pedal assembly 110 to generate triplets, or three consecutive drum beats. Triplets may be generated in any of various ways. For example, a player may simply repeat the foot movement mentioned above for generating a single drum beat three times. One advantage of some embodiments of the present invention is that it facilitates production of three consecutive drum beats in one foot motion cycle. When three consecutive beats are produced by one foot motion cycle, very rapid consecutive beats may be easily achieved. Furthermore, such a foot motion cycle may be repeated as many times as desired to generate more than three consecutive beats.

It was unexpectedly found by the present inventor that pedal assembly 110 comprising curved pedal 130 makes it possible to easily combine heel-toe techniques (or toe-heel techniques) with sliding techniques for easy generation of triplets, for example.

In accordance with such a combined technique, a player may first depress curved pedal 130 with his or her toe to generate a first stroke, tilt his or her toe down, depress curved pedal 130 with his or her toe to generate a second stroke, slide his or her foot in length direction 132, and then depress curved pedal 130 again with his or her toe to generate a third stroke. For example, a foot may be positioned for a first stroke as shown in FIG. 16A, then for a second stroke as shown in FIG. 16B, and then for a third stroke as shown in FIG. 16C. Alternatively, a foot may be positioned for a first stroke as shown in FIG. 16A, then for a second stroke as shown in FIG. 16C, and then for a third stroke as shown in FIG. 16B. Possible foot positions are not limited to those described in FIG. 16A through FIG. 16C.

One advantage of at least some embodiments of the present invention is that curved pedal 130 may make generating triplets easier and less tiring as compared with a conventional flat pedal.

Presence of first convexity 140, first concavity 150, and/or second convexity 160 at curved pedal 130 may facilitate utilization of various sliding and/or heel-toe techniques.

Furthermore, actuatable region 135 of curved pedal 130 may be longer than the corresponding length in a conventional flat pedal. Where this is the case, the greater length of curved pedal 130 may provide space sufficient to allow a player's foot to perform ankle tilting and/or foot sliding motions in sequence, allowing greater degrees of freedom in combining toe-heel techniques and sliding techniques, and making it possible to more easily generate triplets, for example.

Although various foot positions have been shown in FIGS. 16A through 16B, there is of course no limitation on the manner in which curved pedal 130 or pedal assembly 110 is used, the exact foot positions with respect to curved pedal 130 for generation of one or multiple drum beats being freely chosen depending, for example, on the player's preference, the player's foot shape and/or size, whether or not the player is wearing socks, shoes, and/or or other such foot coverings or is playing with bare feet, for example.

Where pedal assembly 110 is used to play high-hat cymbals 104, there is no particular limitation on the manner in which this may be carried out; for example, use of pedal assembly 110 to play high-hat cymbals 104 may be generally similar to use of pedal assembly 110 to play a drum 103 as described above.

Because bass drum 103 in accordance with embodiments of the present invention may permit faster playing than would be possible with a conventional flat pedal, this may allow more versatility in playing than was conventionally possible.

Figure 17:
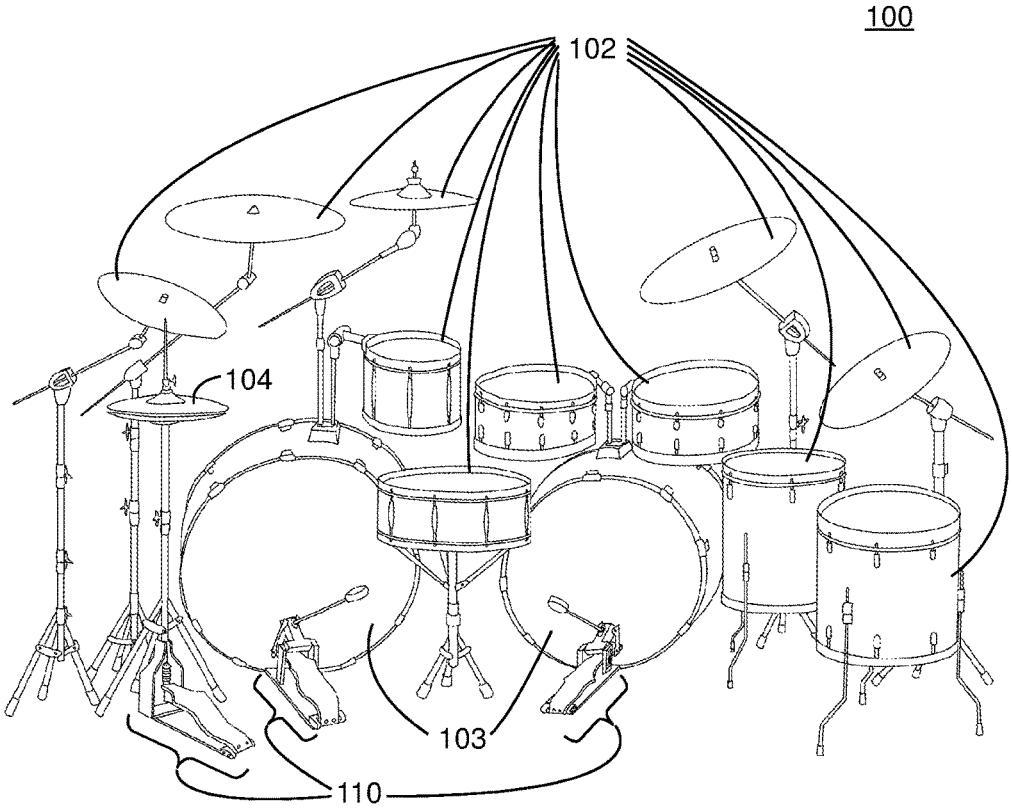
FIG. 17 shows drum set 100 similar to drum set 100 shown in FIG. 1 except that drum set 100 of FIG. 17 contains two bass drums 103, each of which has an independent pedal assembly 110 in accordance with an embodiment of the present invention.

For example, whereas with a conventional flat pedal a player might have been forced to employ two pedals on one drum to achieve a certain degree of frequency of repetitions in striking the drumhead, curved pedal 130 in accordance with embodiments of the present invention may allow such a player to achieve comparable frequency of repetitions with a single curved pedal 130, thus freeing up the other foot to play another drum 103 and/or high-hat cymbals 104. An arrangement suitable for such manner of playing is shown in FIG. 17, which shows a drum set 100 similar to that of FIG. 1 except that drum set 100 of FIG. 17 contains two bass drums 103, each of which has an independent pedal assembly 110 as described above.

Figure 18:
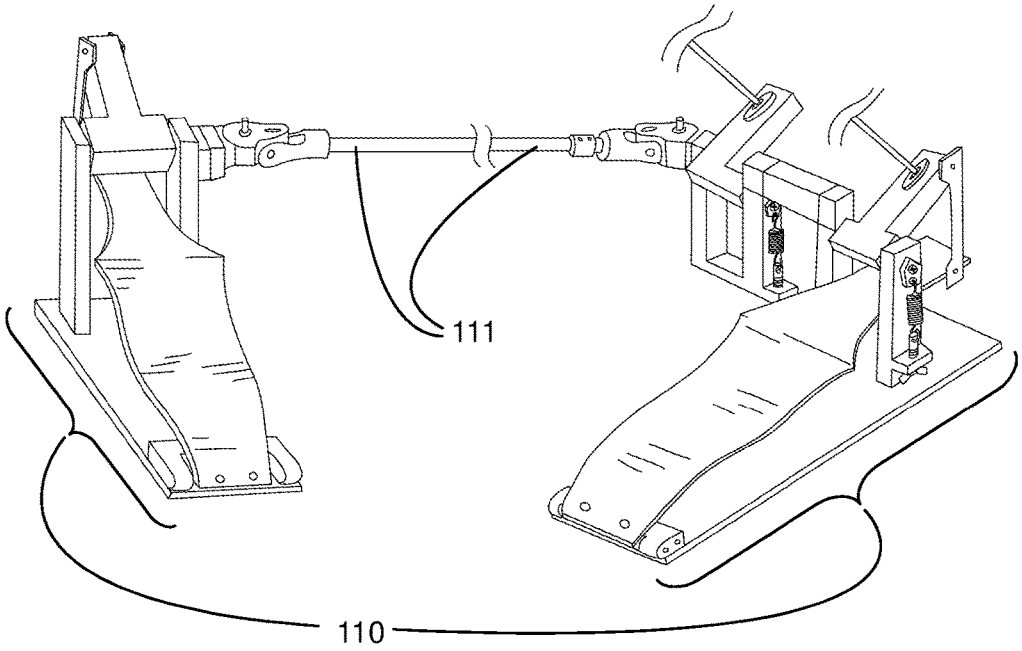
FIG. 18 shows dual pedal linkage 111 which links two pedal assemblies 110 in accordance with an embodiment of the present invention.

Note that a singled curved pedal 130 in accordance with embodiments of the present invention may be used to play multiple instruments through use of a pedal assembly 110 in combination with various linkages may permit tandem and/or parallel playing. Similarly, multiple curved pedals 130 in accordance with embodiments of the present invention may be used in pedal assemblies 110 in combination with various linkages to strike the same and/or different instruments. One such arrangement is shown in FIG. 18, but it should be understood that all such variations are intended to be within the scope of the claims.

Note that curved pedal 130 and pedal assembly 110 are not limited to employment in bass drums 103, percussion instruments 102, drum sets 100, or musical instruments, but may be applied for use in any of a wide variety of applications where dexterity, responsiveness, and comfort are desired, especially when a pedal is to be operated for an extended period of time. Curved pedals 130 and pedal assemblies 110 in accordance with various embodiments of the present invention are particularly useful for generating rapid and/or repeated mechanical motions.

In some embodiments, such mechanical motion may be employed for playing a percussion instrument or non-percussion musical instrument. In one embodiment, such mechanical motions may be transmitted to an instrument directly when part of a pedal assembly physically comes in contact with an instrument. In another embodiment, such mechanical motions may be transformed into another form of signal, for example an electrical signal, and transmitted to an instrument indirectly.

In some embodiments, such mechanical motion may be employed to operate any of various devices and/or machines. Devices and/or machines in which curved pedals 130 and pedal assemblies 110 in accordance with various embodiments of the present invention may be employed include, without limitation, musical instruments, games, video games, toys, playground equipment, automobiles, helicopters, airplanes, backhoes and other such vehicles, construction equipment, and/or heavy equipment, looms, sewing machines, treadles, knitting machines, saws and/or mills, lathes, pumps, and/or other such manufacturing equipment and industrial apparatuses, as well as any of various devices employed in agriculture, forestry, robotics, and/or aerospace, for example. Regardless of field in which the present invention is applied, mechanical motion of foot-actuated curved pedal 130 may be transmitted by way of an assembly similar to pedal assembly 110 to a target device or machine directly or indirectly. Indirect transmission may include, without limitation, electrical transmission. Although the various embodiments of the present invention have been described in terms of an example in which the operator of curved pedal 130 is human, there is no particular limitation to use of curved pedal 130 or to pedal assembly 110 by a non-human, such as a pet or other animal, or by a non-animal such as a robot, for example.

While embodiments of the present invention have been described above, modes of carrying out the present invention are not limited to the foregoing embodiments, a great many further variations being possible without departing from the gist of the present invention.

What is claimed is:

1. A curved foot-actuated percussion musical instrument pedal having a pedal reference plane and having a width direction and a length direction, the curved pedal comprising:

an actuatable region disposed at a top surface of the curved pedal; and at least one curvature profile in the length direction within at least one portion of the actuatable region;

wherein a slope at the top surface relative to the pedal reference plane varies smoothly within the entire actuatable region.

2. The curved pedal according to claim 1 wherein a second spatial derivative with respect to position in the length direction within the at least one portion of the actuatable region is not greater than 30° per inch.

3. The curved pedal according to claim 1 wherein a second spatial derivative with respect to position in the length direction within the at least one portion of the actuatable region is 11.25° per inch±75%.

4. The curved pedal according to claim 1 wherein radius of curvature within the at least one portion of the actuatable region is not less than 3".

5. The curved pedal according to claim 1 wherein radius of curvature within the at least one portion of the actuatable region is 8"±75%.

6. The curved pedal according to claim 1 wherein the at least one curvature profile is more or less sinusoidal with wavelength 10"±50% and amplitude 0.30"±75%.

7. The curved pedal according to claim 1 wherein the at least one curvature profile is more or less elliptically arcuate with radius of curvature 8"±75% and has an extremum of height 0.30"±75% as measured from the pedal reference plane.

8. The curved pedal according to claim 1 wherein the at least one curvature profile is more or less circularly arcuate with radius of curvature 8"±75% and has an extremum of height 0.30"±75% as measured from the pedal reference plane.

9. The curved pedal according to claim 1 wherein the at least one curvature profile is approximated by a polynomial curve of order not less than three with radius of curvature 8"±75% and has an extremum of height 0.30"±75% as measured from the pedal reference plane.

10. The curved pedal according to claim 1 wherein the actuatable region comprises at least one first convexity.

11. The curved pedal according to claim 10 wherein the at least one first convexity is substantially a half-lobe that extends in the length direction not more than 25% peripherally past an extremum of the at least one first convexity.

12. The curved pedal according to claim 1 wherein the actuatable region comprises at least one flat portion.

13. The curved pedal according to claim 1 wherein the actuatable region comprises at least one first concavity.

14. The curved pedal according to claim 11 wherein the actuatable region comprises at least one first concavity.

15. The curved pedal according to claim 14 wherein the actuatable region comprises at least one second convexity.

16. The curved pedal according to claim 15 wherein the at least one first concavity is disposed centrally in the length direction between the at least one first convexity and the at least one second convexity.

17. The curved pedal according to claim 1 wherein length of actuatable region in the length direction is not less than 12".

18. The curved pedal according to claim 1 wherein the curved pedal comprises a heel end having at least one feature permitting mounting to a heel hinge; and a toe end having at least one feature permitting mounting to at least one pivoting linkage arm.

19. A pedal assembly comprising:

a curved foot-actuated percussion musical instrument pedal associated with a pedal reference plane and having a heel end and a toe end;

a baseboard associated with a baseboard plane and having a heel end and a toe end;

a heel hinge; and a motion transmission linkage;

wherein the heel end of the curved pedal is pivotably mounted by way of the heel hinge to the heel end of the baseboard so as to permit the toe of the curved pedal to operate the motion transmission linkage; and wherein slope at a top surface of the curved pedal varies smoothly relative to the pedal reference plane within an entire actuatable region in a length direction of the curved pedal.

20. A drum set comprising at least one percussion instrument actuated by a pedal assembly comprising:

a curved foot-actuated percussion musical instrument pedal associated with a pedal reference plane and having a heel end and a toe end;

a baseboard associated with a baseboard plane and having a heel end and a toe end;

a heel hinge; and a motion transmission linkage;

wherein the heel end of the curved pedal is pivotably mounted by way of the heel hinge to the heel end of the baseboard so as to permit the toe of the curved pedal to operate the motion transmission linkage; and wherein slope at a top surface of the curved pedal varies smoothly relative to the pedal reference plane within an entire actuatable region in a length direction of the curved pedal.

* * * * *